US010054910B2

(12) United States Patent
Nagareda

(10) Patent No.: US 10,054,910 B2
(45) Date of Patent: Aug. 21, 2018

(54) ELECTRONIC TIMEPIECE, COMMUNICATION SYSTEM AND STORAGE MEDIUM

(71) Applicant: CASIO COMPUTER CO., LTD., Shibuya-ku, Tokyo (JP)

(72) Inventor: Hirofumi Nagareda, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/980,279

(22) Filed: Dec. 28, 2015

(65) Prior Publication Data

US 2016/0246264 A1 Aug. 25, 2016

(30) Foreign Application Priority Data

Feb. 24, 2015 (JP) ..... 2015-033530

(51) Int. Cl.
*G04R 20/26* (2013.01)
*G04R 20/14* (2013.01)
(Continued)

(52) U.S. Cl.
CPC ..... *G04R 20/26* (2013.01); *G04G 7/00* (2013.01); *G04G 9/0076* (2013.01); *G04R 20/30* (2013.01); *G04R 20/14* (2013.01)

(58) Field of Classification Search
CPC ..... G04G 5/00; G04G 7/02; G04G 9/0076; G04G 7/00; G04R 20/12; G04R 20/14; G04R 20/18; G04R 20/26; G04R 20/30
See application file for complete search history.

(56) References Cited

U.S. PATENT DOCUMENTS 6,219,302 B1 * 4/2001 Tanoguchi ..... G04R 20/12 368/187
6,288,977 B1 * 9/2001 Yoshida ..... G04R 20/12 368/187

(Continued)

FOREIGN PATENT DOCUMENTS

CN 104281049 A 1/2015
EP 2293157 A2 3/2011

(Continued)

OTHER PUBLICATIONS

Extended European Search Report dated Jul. 18, 2016, issued in counterpart European Application No. 15201568.1.

(Continued)

*Primary Examiner* — Vit W Miska
(74) *Attorney, Agent, or Firm* — Holtz, Holtz & Volek PC

(57) ABSTRACT

An electronic timepiece includes a timer unit, a timepiece-side communication unit, a timepiece-side daylight saving time information storage unit and a processor. The timer unit counts local time at a current position. The timepiece-side communication unit communicates with an external device. The timepiece-side daylight saving time information storage unit stores daylight saving time implementation information therein at least at the current position. The processor corrects the local time in correspondence to an implementation situation of daylight saving time at the current position, based on the daylight saving time implementation information, acquires update information of the daylight saving time implementation information from the external device through the timepiece-side communication unit and reflects the acquired update information in the daylight saving time implementation information.

19 Claims, 13 Drawing Sheets

(51) Int. Cl.

| | |
|---|---|
| ***G04R 20/30*** | (2013.01) |
| ***G04G 7/00*** | (2006.01) |
| ***G04G 9/00*** | (2006.01) |

(56) References Cited

U.S. PATENT DOCUMENTS 6,459,657 B1 * 10/2002 Takada ..... G04C 13/02 368/46
8,054,820 B2 * 11/2011 Park ..... G04G 9/0076 368/21
9,158,287 B2 * 10/2015 Ono ..... G04R 20/18
9,204,249 B2 * 12/2015 Huang ..... H04W 4/021
9,383,728 B2 * 7/2016 Wu ..... G04G 5/00
9,417,612 B2 * 8/2016 May ..... G04G 9/0076
2002/0098857 A1 * 7/2002 Ishii ..... G04G 5/00 455/502
2005/0124306 A1 * 6/2005 Cheng ..... G04R 20/14 455/158.4
2005/0162981 A1 * 7/2005 O'Neill ..... G04G 15/00 368/46
2006/0002236 A1 1/2006 Punkka
2006/0171257 A1 * 8/2006 Cormier ..... G04G 9/0076 368/47
2007/0177463 A1 * 8/2007 Kataoka ..... H04L 7/0008 368/21
2007/0206442 A1 9/2007 Kim
2007/0217291 A1 * 9/2007 Jeong ..... G04G 9/0076 368/21
2009/0028006 A1 * 1/2009 Ha ..... G04G 5/00 368/46
2011/0051559 A1 * 3/2011 Oh ..... G04G 9/0076 368/10
2011/0237237 A1 * 9/2011 Kashikar ..... H04M 1/72572 455/419
2011/0280108 A1 11/2011 Honda
2013/0077448 A1 * 3/2013 Matsuo ..... G04R 20/12 368/21
2014/0031065 A1 * 1/2014 Schonbrun ..... H04W 4/02 455/456.2
2014/0066064 A1 3/2014 Huang et al.
2014/0092713 A1 * 4/2014 Wu ..... G04G 5/00 368/46
2014/0149560 A1 * 5/2014 Hakami ..... H04L 67/1095 709/221
2014/0302876 A1 10/2014 Oizumi et al.
2016/0041532 A1 * 2/2016 Honda ..... G04R 20/02 368/47

FOREIGN PATENT DOCUMENTS

| | | | |
|---|---|---|---|
| EP | 2579111 | A2 | 4/2013 |
| JP | 60056286 | A | 4/1985 |
| JP | 2006029960 | A | 2/2006 |
| JP | 2009118403 | A | 5/2009 |
| JP | 2012173021 | A | 9/2012 |
| JP | 2014211430 | A | 11/2014 |

OTHER PUBLICATIONS

Chinese Office Action dated Sep. 13, 2017 issued in counterpart Chinese Application No. 201610101351.0.
European Office Action dated Jan. 24, 2018 issued in counterpart European Application No. 15201568.1.
Japanese Office Action (and English translation thereof) dated Dec. 20, 2016 issued in Japanese counterpart Application No. 2015-033530.

* cited by examiner

FIG. 4A

| VERSION:0003 | | | | | | |
|---|---|---|---|---|---|---|
| NO. | START DATE | START TIME | END DATE | END TIME | PASSING OF YEAR | LT/UTC |
| 1 | SECOND SUNDAY IN MARCH | 2 O'CLOCK A.M. | FIRST SUNDAY IN NOVEMBER | 2 O'CLOCK A.M. | 0 | 0 |
| 2 | FINAL SUNDAY IN MARCH | 1 O'CLOCK A.M. | FINAL SUNDAY IN OCTOBER | 1 O'CLOCK A.M. | 0 | 1 |
| 3 | FINAL SUNDAY IN MARCH | 3 O'CLOCK A.M. | FINAL SUNDAY IN OCTOBER | 4 O'CLOCK A.M. | 0 | 0 |
| 4 | FIRST SUNDAY IN OCTOBER | 3 O'CLOCK A.M. | FIRST SUNDAY IN APRIL | 4 O'CLOCK A.M. | 1 | 0 |
| ⋮ | | | | | | |
| 23 | FINAL SUNDAY IN SEPTEMBER | TWO FORTY-FIVE | FIRST SUNDAY IN APRIL | THREE FORTY-FIVE | 1 | 0 |
| 24 | FIRST SATURDAY IN SEPTEMBER | 10 O'CLOCK P.M. | FOURTH SATURDAY IN APRIL | 10 O'CLOCK P.M. | 1 | 0 |
| 25 | | | | | | |
| ⋮ | | | | | | |

FIG. 4B

| VERSION: 0003 | | | | | | |
|---|---|---|---|---|---|---|
| NO. | CITY NAME | COUNTRY | TZ | DST NO. | DST SHIFT | DST SET |
| 1 | TOKYO | JPN | +9:00 | 0 | 0 | 0 |
| 2 | NEW YORK | USA | -5:00 | 1 | 1:00 | 0 |
| 3 | SAN FRANCISCO | USA | -8:00 | 1 | 1:00 | 0 |
| 4 | LONDON | GBR | +0:00 | 2 | 1:00 | 0 |
| 5 | PARIS | FRA | +1:00 | 2 | 1:00 | 0 |
| 6 | HELSINKI | FIN | +2:00 | 2 | 1:00 | 0 |
| 7 | ANKARA | TUR | +2:00 | 3 | 1:00 | 0 |
| 8 | ADELEIDE | AUS | +9:30 | 4 | 1:00 | 0 |
| ⋮ | | | | | | |

(FIG. 8 CONTINUED)
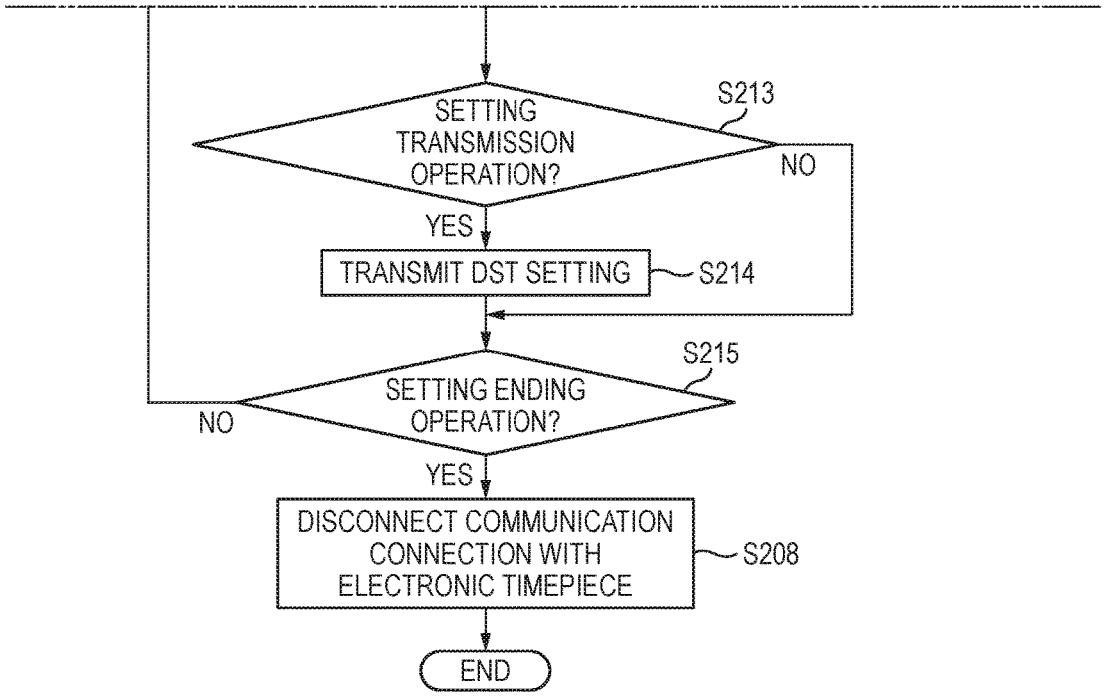

(FIG. 11 CONTINUED)
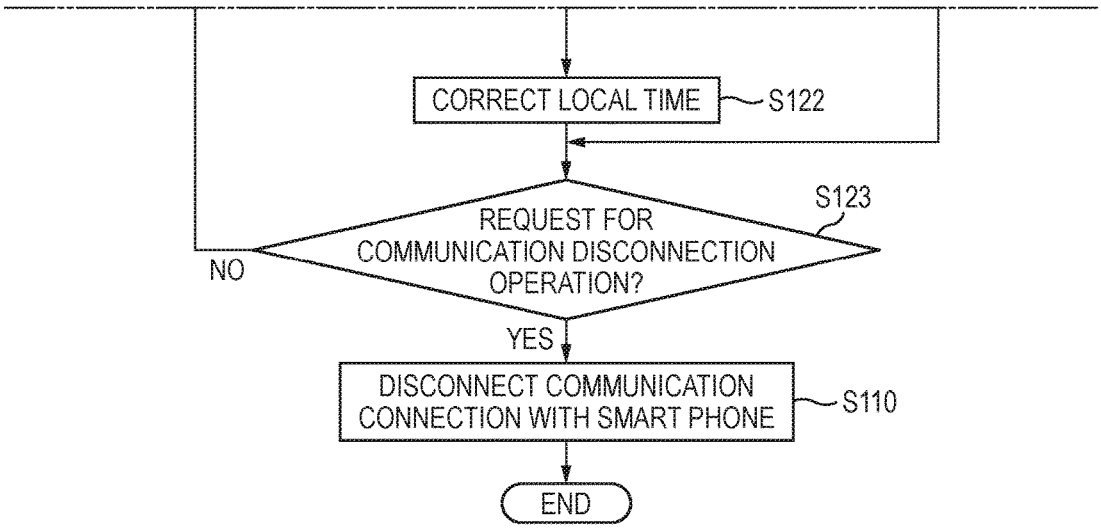

ELECTRONIC TIMEPIECE, COMMUNICATION SYSTEM AND STORAGE MEDIUM

CROSS-REFERENCE TO RELATED APPLICATION

This application is based upon and claims the benefit of priority from the prior Japanese Patent Application No. 2015-033530, filed on Feb. 24, 2015, and the entire contents of which are incorporated herein by reference.

BACKGROUND OF THE INVENTION

1. Field of the Invention

The disclosure relates to an electronic timepiece, a communication system relating to an operation setting of the electronic timepiece and a storage medium.

2. Description of the Related Art

In the related art, an electronic timepiece having functions of acquiring correct date and time information from an outside and correcting counted date and time has been known. By the functions, it is possible to omit a technology for increasing a degree of counting precision of a built-in clock of the electronic timepiece and a user's labor on correction of the built-in clock.

As an outside supply source of the correct date and time information, a standard radiowave, a positioning satellite, a mobile phone, a smart phone and the like may be exemplified. The electronic timepiece, particularly, a portable and wearable type such as an electronic wristwatch has problems that it is difficult to perform high-speed communication, which causes increases in power consumption and a memory size, due to restraints such as a size, a weight and an amount of heat generation of the electronic timepiece and that it is difficult to perform complex transmission and reception operations due to an operational problem. Therefore, the electronic timepiece has been conventionally configured to acquire fixed data of which a size relating to the date and time information is small mainly by using wireless communication and to correct the date and time. For example, JP-A-2009-118403 discloses a technology of timely receiving correct date and time from a mobile phone by using Bluetooth communication (registered trademark: Bluetooth).

From the standard radiowave, the mobile phone, the smart phone and the like of the date and time information supply sources, local times corresponding to a reception area of the standard radiowave and a connection region of the mobile phone are acquired. In this case, the daylight saving time is implemented in some regions of the world, so that if the time counting continues in the electronic timepiece with the acquired date and time being kept as it is, a deviation occurs between the counted time and the actual local time at start and end timings of the daylight saving time. Regarding this, an electronic timepiece capable of automatically switching and displaying local time depending on preset cities and areas in various regions of the world has been known. According to this electronic timepiece, the implementation information of the daylight saving time corresponding to the city and area is stored in advance and the local time can be corrected at the start and end timings of the daylight saving time.

However, there are a variety of settings with respect to the start and end timings of the daylight saving time and the shift time from the standard time during an implementation time period. The settings are frequently varied depending on political, religious and economic situations. In recent years, the setting information can be easily acquired with an electronic device connected to the Internet. However, according to the electronic timepiece, particularly, a portable small timepiece, it is difficult to change the daylight saving time setting and the manual correction of the setting is very troublesome and requires much effort. In the meantime, regarding the electronic timepiece, if the user should manually correct the setting as the daylight saving time starts or ends, the user may feel a high burden and forget to correct the setting, so that the confusion may be caused. Due to these causes, the electronic timepiece of the related art cannot easily keep the counting of the correct local time reflecting the daylight saving time.

SUMMARY OF THE INVENTION

It is therefore an object of the disclosure to provide an electronic timepiece capable of easily keeping counting of correct local time, a communication system and a storage medium.

An electronic timepiece of the present invention includes a timer unit, a timepiece-side communication unit, a timepiece-side daylight saving time information storage unit and a processor. The timer unit counts local time at a current position. The timepiece-side communication unit communicates with an external device. The timepiece-side daylight saving time information storage unit stores daylight saving time implementation information therein at least at the current position. The processor corrects the local time in correspondence to an implementation situation of daylight saving time at the current position, based on the daylight saving time implementation information, acquires update information of the daylight saving time implementation information from the external device through the timepiece-side communication unit and reflects the acquired update information in the daylight saving time implementation information.

BRIEF DESCRIPTION OF THE DRAWINGS

FIGS. 4A and 4B depict table data relating to setting information of local time.

DETAILED DESCRIPTION

Hereinafter, an illustrative embodiment of the disclosure will be described with reference to the drawings.

Figure 1:
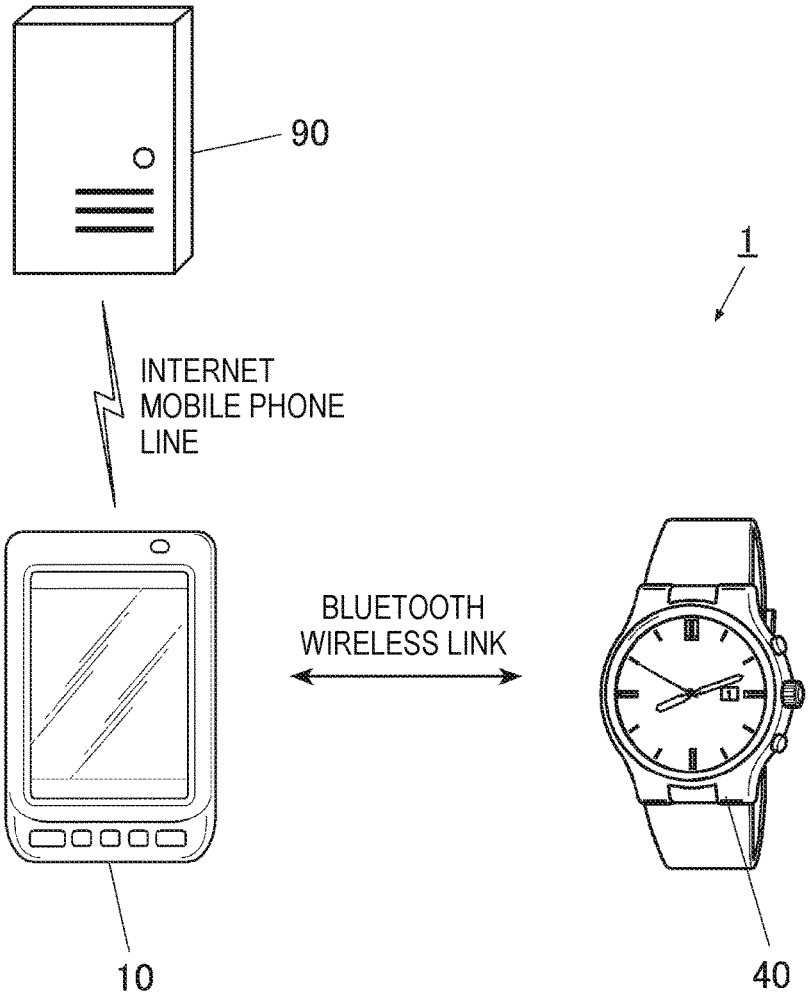
FIG. 1 depicts an entire communication system of an illustrative embodiment of the disclosure.

FIG. 1 depicts an entire communication system 1 of an illustrative embodiment of the disclosure.

The communication system 1 includes an electronic timepiece 40 and a smart phone 10 serving as an external device, an electronic device and a computer. The electronic timepiece 40 is an analog electronic timepiece configured to rotate a plurality of indicators and to display information such as time by directions indicated by the plurality of indicators being rotated, and is also a wristwatch that can be worn on a wrist by a belt.

The electronic timepiece 40 and the smart phone 10 can perform wireless communication with each other by Bluetooth (registered trademark: Bluetooth). Also, the smart phone 10 can connect to an external data server 90 via a base station of mobile phone communication or an access point of a wireless LAN (IEEE 802.11). The external data server 90 is a server apparatus such as a cloud server, for example, and is configured to store therein the latest information of local time settings such as time zone settings and daylight saving time implementation settings in various regions of the world. Meanwhile, in the communication system 1 of the illustrative embodiment, a mobile phone rather than the smart phone 10 can also be used inasmuch as it can connect to the base station of the mobile phone communication and the external data server 90.

Figure 2:
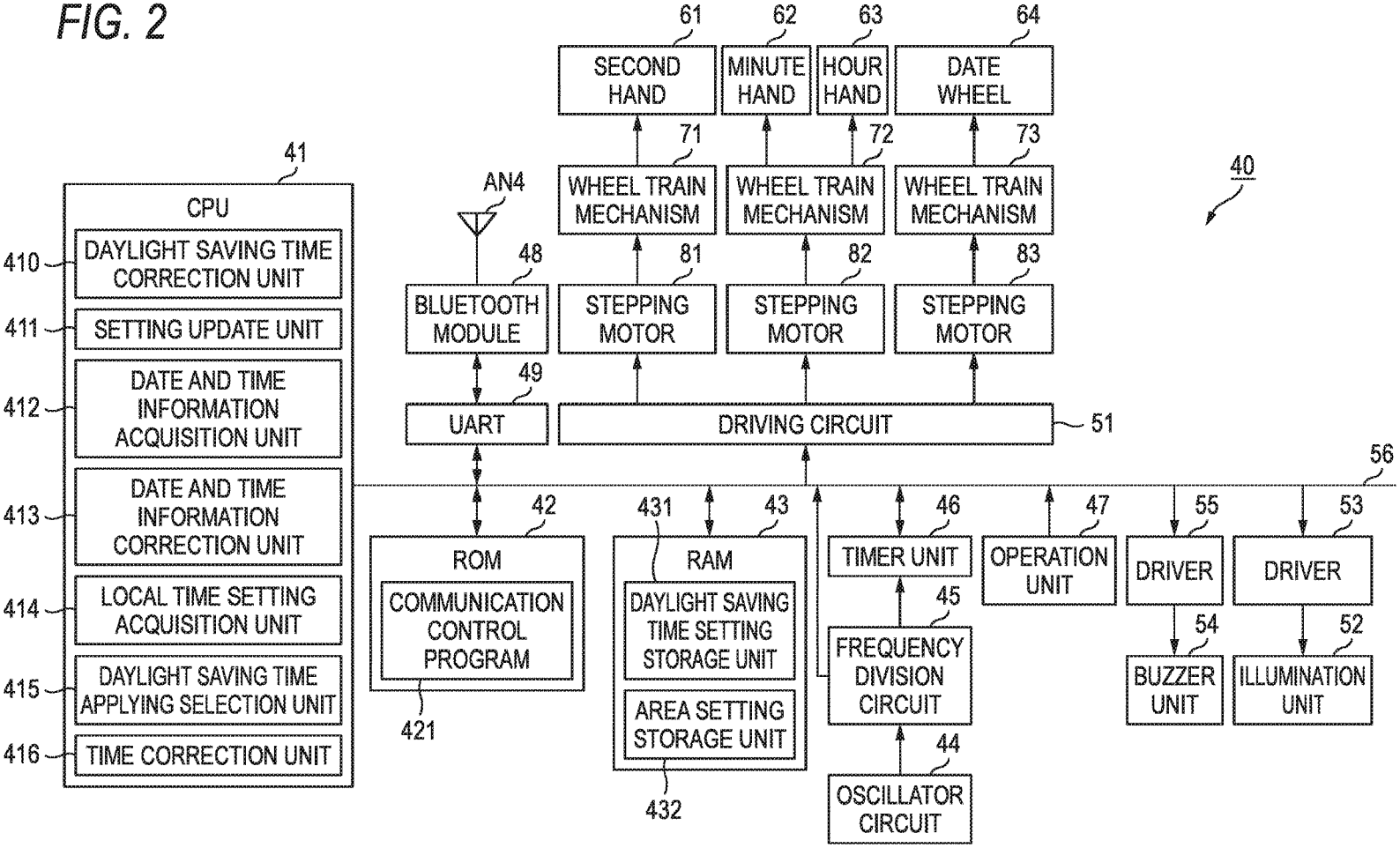
FIG. 2 is a block diagram depicting a functional configuration of an electronic timepiece.

FIG. 2 is a block diagram depicting a functional configuration of the electronic timepiece 40.

The electronic timepiece 40 includes a CPU 41 (Central Processing Unit) (a daylight saving time correction unit 410, a setting update unit 411, a date and time information acquisition unit 412, a date and time correction unit 413, a local time setting acquisition unit 414, a daylight saving time applying selection unit 415), a ROM 42 (Read Only Memory), a RAM 43 (Random Access Memory), an oscillator circuit 44, a frequency division circuit 45, a timer unit 46 (the timer unit), an operation unit 47 (the operation unit), a Bluetooth module 48 (the timepiece-side communication unit) and an antenna AN4 thereof, a UART 49 (Universal Asynchronous Receiver/Transmitter), an illumination unit 52 and a driver 53 thereof, a buzzer unit 54 and a driver 55 thereof, a second hand 61, a stepping motor 81 configured to rotate the second hand 61 through a wheel train mechanism 71, a minute hand 62, a hour hand 63, a stepping motor 82 configured to rotate the minute hand 62 and the hour hand 63 through a wheel train mechanism 72, a date wheel 64, a stepping motor 83 configured to rotate the date wheel 64 through a wheel train mechanism 73, a bus 56 and the like. The CPU 41 includes a daylight saving time correction unit 410, a setting update unit 411, a date and time information acquisition unit 412, a date and time correction unit 413, a local time setting acquisition unit 414, and a daylight saving time applying selection unit 415. The daylight saving time correction unit 410, the setting update unit 411, the date and time information acquisition unit 412, the date and time correction unit 413, the local time setting acquisition unit 414 and the daylight saving time applying selection unit 415 may be a single CPU or may perform respective operations by CPUs separately provided.

The CPU 41 is configured to execute a variety of calculation processing and to collectively control the entire operations of the electronic timepiece 40. The CPU 41 is configured to read out and execute a variety of programs relating to operations of the electronic timepiece 40 from the ROM 42.

In the ROM 42, a variety of control programs relating to the operations of the electronic timepiece 40 and initial setting data are stored. The programs include a communication control program 421 for performing communication with the smart phone 10.

The RAM 43 is configured to provide the CPU 41 with a memory space for work and to store therein date and time data. The date and time data stored in the RAM 43 includes a daylight saving time setting storage unit 431 (the timepiece-side daylight saving time information storage unit) configured to store therein an implementation content setting of the daylight saving time (the daylight saving time implementation information), which is to be implemented in the world, and an area setting storage unit 432 configured to store therein a city (setting position), which is to be set as a current position, a time zone to which one or more cities including the corresponding city belong, and an implementation content of the daylight saving time that is to be implemented in the corresponding city (which is collectively referred to as the local time setting). The RAM 43 may include an overwritable non-volatile memory such as a flash memory. In this case, the data of the daylight saving time setting storage unit 431 and the area setting storage unit 432 is preferably stored in the non-volatile memory. Also, the implementation content setting of the daylight saving time, the setting of the time zone and the like may be stored in the ROM 42, as the initial settings, and may be read out and stored in the RAM 43 upon activation or using. The implementation content setting of the daylight saving time may be updated based on update information that is to be acquired from the smart phone 10.

Meanwhile, here, the current position is set as an area having a predetermined size, not one point. Also, an associated city name is an example of a name representative of the area. The disclosure is not limited thereto. For example, the other administrative district such as a country name and a state name, a geographical section such as an island name, a latitude and longitude range and the like may also be adopted.

The oscillator circuit 44 is configured to generate and output a predetermined frequency signal. The frequency division circuit 45 is configured to divide the frequency output from the oscillator circuit 44 into signals of frequencies that are to be used in the electronic timepiece 40, and to output the same.

The timer circuit 46 is configured to count and keep current time by counting the signal input from the frequency division circuit 45 and adding the number of input times to initial date and time data. The timer unit 46 is not limited to a counter having a hardware configuration and may be configured to store therein the current time counted in a software manner under control of the CPU 41.

The timer unit 46 may be configured to count an individual counting value, which can be converted into current date and time such as UTC based on a predetermined criterion, and to convert the counted value into UTC date and time or local time in a city set as a current position or may be configured to directly count UTC date and time or local time of a current position. Also, an individual counting value may be counted by a hardware configuration such as a counter and converted UTC date and time or date and time of local time may be stored in a RAM. The RAM may be the same as the RAM 43 or may be separately provided. In the below, an example where the timer unit 46 is configured to count an individual counting value (reference date and time) (the reference date and time counting unit) and to calculate local time by converting the counted value based on the time zone, the daylight saving time implementation information and the like (the local time conversion unit) will be exemplified. The current time that is to be counted by the timer unit 46 can be corrected by a control signal from the CPU 41. In the timer unit 46, a date and time deviation correction may be performed with respect to an error of the oscillator circuit 44 or the frequency division circuit 45 and a time difference from the UTC date and time due to a change of the current position may be corrected.

The operation unit 47 has a push-button switch and a stem, which are a mechanism configured to receive an input from an outside, and is configured to generate an electric signal corresponding to a user input operation and to output the same to the CPU 41, as an input signal. By the user operation on the operation unit 47, it is possible to perform a simple operation such as switching of DST setting (switching setting), which will be described later, for example.

The Bluetooth module 48 is a control module for performing Bluetooth communication with the external device such as the smart phone 10 through the antenna AN4. The transmission data transmitted from the CPU 41 is subject to processing such as serial/parallel conversion in the UART 49, and is then transmitted to the external device from the Bluetooth module 48. Also, the reception data received by the antenna AN4 and the Bluetooth module 48 is subject to processing such as serial/parallel conversion in the UART 49 and is then output to the CPU 41.

The illumination unit 52 is configured to illuminate a dial plate of the electronic timepiece 40, in correspondence to a driving voltage output from the driver 53 by a control signal from the CPU 41. As the illumination unit 52, an LED (light emitting diode) is used, for example. Also, the buzzer unit 54 is configured to generate a buzzer sound (beep sound), in correspondence to a driving signal output from the driver 55 by a control signal from the CPU 41. As a mechanism of generating the buzzer sound, a method of combining a piezoelectric element and a metal plate and vibrating the metal plate in correspondence to a voltage to be applied to the piezoelectric element may be adopted, for example.

The motor driving circuit 51 is configured to output driving signals for rotating the indicators 61 to 64 to the stepping motors 81 to 83 at appropriate timings, lengths and voltages, based on control signals from the CPU 41.

The stepping motors 81 to 83 are configured to rotate by predetermined angles (for example, 180°) in correspondence to the driving signals from the motor driving circuit 51 and to rotate the wheel train mechanisms 71 to 73 by predetermined angles, which are toothed wheel trains for rotating the indicators 61 to 64, respectively. Here, the stepping motors 81 to 83 are configured to rotate the second hand 61 by 6 (six) degrees, the minute hand 62 by 1 (one) degree and the date wheel 64 by 360/(31×170) degree, for example. The hour hand 63 is configured to rotate in a rotation angle ratio of 1:12 with respect to the minute hand 62 and in conjunction with the minute hand 62.

Figure 3:
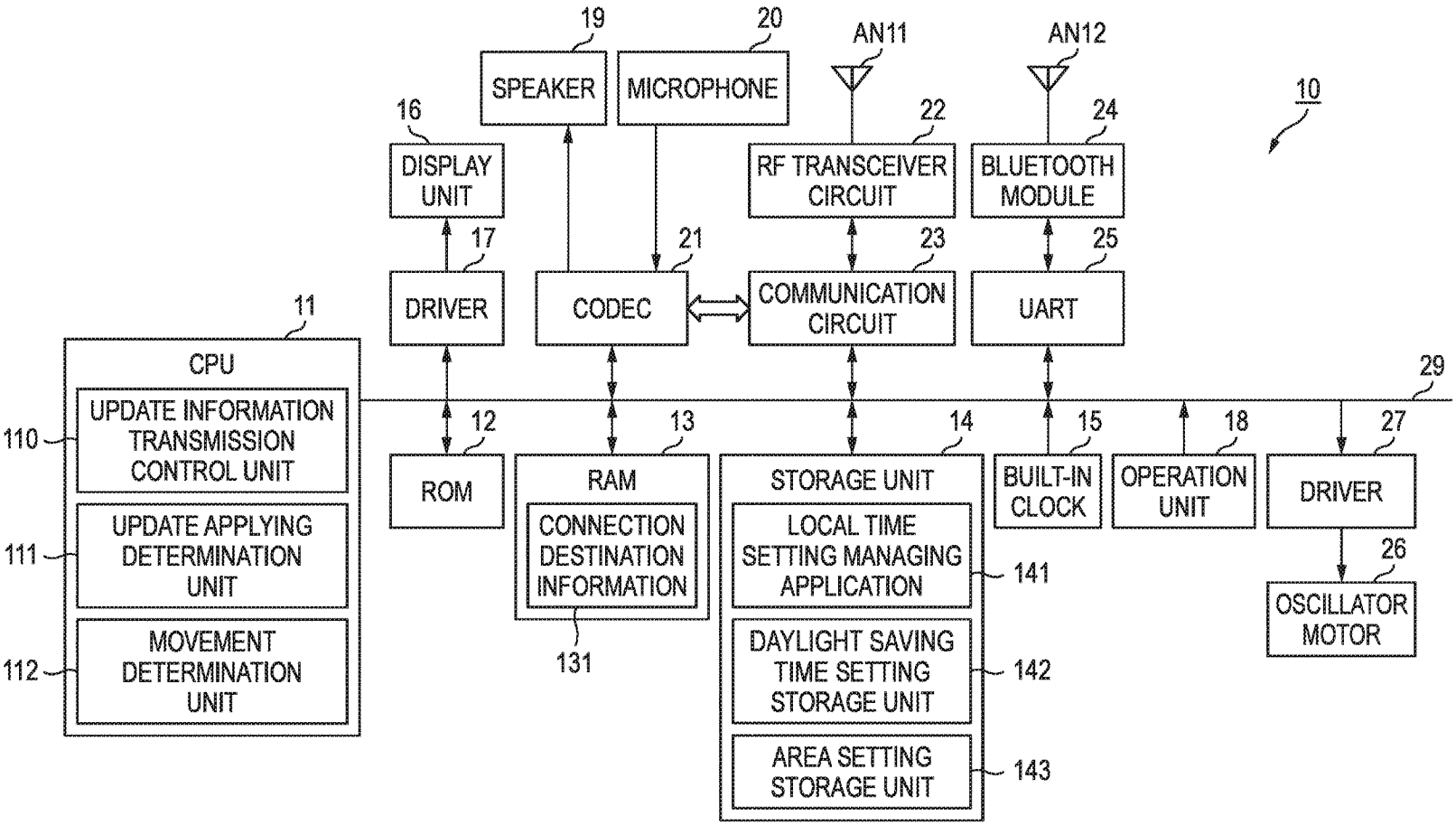
FIG. 3 is a block diagram depicting a functional configuration of a smart phone.

FIG. 3 is a block diagram depicting a functional configuration of the smart phone 10.

The smart phone 10 includes a CPU 11 (an update information transmission control unit 110, an update applying determination unit 111, a movement determination unit 112), a ROM 12, a RAM 13, a storage unit 14, a built-in clock 15, a display unit 16 and a driver 17 thereof, an operation unit 18, a speaker 19, a microphone 20, a CODEC 21, an RF transceiver circuit 22, an antenna AN11 for transmitting and receiving an RF communication radiowave, a communication circuit 23, a Bluetooth module 24 (the device-side communication unit), a UART 25, an antenna AN12 for transmitting and receiving a Bluetooth communication radiowave, a vibration motor 26 and a driver 27 thereof, a bus 29, and the like. The CPU 11 includes an update information transmission control unit 110, an update applying determination unit 111, and a movement determination unit 112. The update information transmission control unit 110, the update applying determination unit 111 and the movement determination unit 112 may be a single CPU or may perform respective operations by CPUs separately provided.

The CPU 11 is configured to execute a variety of calculation processing and to collectively control the entire operations of the smart phone 10. The CPU 11 manages the local time setting of the electronic timepiece 40 by a local time setting managing application 141 when the smart phone 10 and the electronic timepiece 40 are connected by the Bluetooth communication. Also, the CPU 11 is configured to specify a current position (city) of the smart phone 10, based on information of the base station of the mobile phone communication to which the RF transceiver circuit 22 is to be connected. Also, the CPU 11 is configured to connect to the Internet through the RF transceiver circuit 22 and to acquire the latest daylight saving time implementation information from the external data server 90. The CPU 11 and the RF transceiver circuit 22 configure the current position acquisition unit and the update information acquisition unit.

The ROM 12 is configured to store therein a variety of programs, which are to be executed by the CPU 11, and initial setting data. In the meantime, at least a part of the ROM 12 may be an overwritable non-volatile memory.

The RAM 13 is a volatile memory configured to provide the CPU 41 with a memory space for work and to store therein date and time data for work.

The storage unit 14 has a readable and overwritable non-volatile memory, for example, a flash memory and an EEPROM (Electrically Erasable and Programmable Read Only Memory). The data stored in the storage unit 14 includes the local time setting managing application 141 (program), a daylight saving time setting storage unit 142 (the device-side daylight saving time information storage unit) and an area setting storage unit 143 (the local time setting storage unit). The CPU 11 is configured to read out and execute the local time setting managing application 141, to update data of the daylight saving time setting storage unit 142 and the area setting storage unit 143, and to transmit the update data to the electronic timepiece 40 when the smart phone is communication-connected to the electronic timepiece 40 through the Bluetooth communication. That is, here, the data to be stored in the daylight saving time setting storage unit 142 and the area setting storage unit 143 has the same format as the daylight saving time setting storage unit 431 and the area setting storage unit 432 stored in the electronic timepiece 40. Alternatively, the data has a format that is at least completely compatible.

The built-in clock 15 is a counter configured to count and keep current time. The current time may be counted in a software manner by the operation of the CPU 11 and stored in the RAM and the like. The built-in clock 15 has an RTC (Real Time Clock). When the built-in clock 15 is reactivated after a power supply of the smart phone 10 is off, the date and time data is acquired from the RTC and the counting is resumed. In the smart phone 10, the current time of the built-in clock 15 is read out, so that the local time is calculated in correspondence to the time zone and the implementation setting of the daylight saving time, as required, and is displayed on the display unit 16 or is used for a variety of processing. Also, the current time and setting time relating to various functions are compared for a variety of operations. The current time data of the built-in clock 15 is corrected by time data, which is frequently acquired from the base station of the mobile phone communication, upon the communication with the base station of the mobile phone communication by the RF transceiver circuit 22.

The display unit 16 has a display screen for diverse displays. As the display screen, for example, a liquid crystal monitor (LCD) is used. The driver 17 (liquid crystal driver) configured to operate by a control signal from the CPU 11 is configured to drive the LCD in correspondence to the control signal, thereby displaying a variety of functions on the display screen. The display unit 16 may have a display screen of another display type, for example, an organic ELD (Electro-Luminescent Display), and the driver 17 is appropriately selected in correspondence to the display type of the display screen. The display unit 16 may further have an LED lamp and the like.

The operation unit 18 has a touch panel and is configured to detect a touch operation position and an operation content of the user on the touch panel overlapping with the display screen of the display unit 16, to generate an electric signal corresponding to the user operation and to output the same to the CPU 11, as an input signal. The operation unit 18 may further have one or more operation keys and switches, and may be configured to output an input signal based on a user operation on the operation keys and switches to the CPU 11.

The speaker 19 is configured to convert an electric signal based on a signal from the CODEC 21 into a voice signal and to output a voice. Also, the microphone 20 is configured to detect an acoustic wave, to convert the same into an electric signal, and to output the electric signal to the CODEC 21. The CODEC 21 is configured to decode an encoded and compressed digital voice signal, to send the digital signal to the speaker 19 as an analog signal, to encode the voice signal acquired from the microphone 20 and to output the encoded voice signal to the CPU 11 and the communication circuit 23. In the meantime, a speaker for call and a speaker for outputting the other alarm sounds to the outside may be separately provided.

The RF transceiver circuit 22 is configured to transmit and receive signals relating to phone communication and data communication, which are to be performed with the base station of the mobile phone communication through the antenna AN11 for transmission and reception of RF communication. The communication circuit 23 is configured to execute a variety of processing for data, which is to be transmitted and received by the RF transceiver circuit 22, and to transmit and receive the data to and from the CPU 11 and the CODEC 21. Also, the RF transceiver circuit 22 is configured to connect to an access point of a wireless LAN and to transmit and receive data (data communication) to and from respective destinations on the Internet including the external data server 90 through the wireless LAN.

The Bluetooth module 24 is a control module configured to perform Bluetooth communication with the external device such as the electronic timepiece 40 through the antenna AN12. The transmission data transmitted from the CPU 11 is subject to the processing such as serial/parallel conversion and the like in the UART 25 and is then transmitted from the Bluetooth module 24 to the external device. Also, the reception data received from the external device through the Bluetooth module 24 is subject to the processing such as parallel/serial conversion and the like in the UART 25 and is then output to the CPU 11.

The vibration motor 26 is provided to generate vibrations and to inform the user of the same. When a control signal is transmitted from the CPU 11 to the driver 27, the driver 27 converts the control signal into a voltage signal necessary to operate the vibration motor 26 and outputs the same. As the vibration motor 26, a rotation motor is used, for example.

The bus 29 is a data path for enabling signals to be transmitted and received between the CPU 11 and the respective configurations in the smart phone 10.

In the below, local time calculation processing that is to be executed in the electronic timepiece 40 of the illustrative embodiment is described.

Based on the setting information of the time zone at the current position stored in the area setting storage unit 432, the electronic timepiece 40 applies a time difference to date and time counted by the timer unit 46, thereby calculating local time by the standard time. Also, the implementation information of the daylight saving time at the current position is read out from the daylight saving time setting storage unit 431, and it is determined whether the calculated local time by the standard time is under implementation of the daylight saving time. When it is determined that the daylight saving time is implemented, shift time is added, so that the local time in the daylight saving time is calculated.

When the local time is calculated once, as described above, the local time is kept in the RAM 43 and the like and can be counted together with the date and time that is to be counted by the timer unit 46. In this case, it is determined at a predetermined interval, for example 15 minute-interval whether the local time is the same as start date and time or end date and time of the daylight saving time. When they are the same, a correction of adding the shift time or returning the added shift time to an original state is performed.

FIGS. 4A and 4B depict table data relating to the setting information of the local time.

As described above, the daylight saving time setting storage unit 431 and the area setting storage unit 432 are included in the RAM 43. Also, the daylight saving time setting storage unit 142 and the area setting storage unit 143 are included in the storage unit 14. As shown in FIG. 4A, the daylight saving time setting storage unit 431 and the daylight saving time setting storage unit 142 store, as the implementation content setting of the daylight saving time, the information relating to the start date and time and end date and time of the daylight saving time (the implementation time period of the daylight saving time) numbered (here, from No. 1 to No. 24) for each implementation pattern. Also, the daylight saving time setting storage unit 431 and the daylight saving time setting storage unit 142 are provided with a preliminary memory of No. 25 and thereafter for additionally storing a new implementation pattern when the new implementation pattern is generated. In the meantime, No. 0 corresponds to non-implementation of the daylight saving time. Also, here, when the daylight saving time ends in the next year of the start thereof in the Southern Hemisphere, a flag 'across the years' is set to '1', and when the daylight saving time starts and ends in the same year in the Northern Hemisphere, the flag 'across the years' is set to '0.' Also, the start and end timings of the daylight saving time may be determined based on the local time and UTC time. When the UTC time is used as the reference time, a selection flag IT/UTC' is set to '1.'

As shown in FIG. 4B, in the area setting storage unit 143, a number (selection information) indicative of an implementation pattern of the daylight saving time is associated and stored with the time zone and the shift time information for each pre-settable city, as the local time setting. Also, a DST setting value, which is a parameter relating to an applying setting of the daylight saving time (a setting based on an input operation as to whether the daylight saving time is to be implemented), is determined for each city, is included in the local time setting, and is stored in the area setting storage unit 143. The DST setting value is any one of values '0' to '2' corresponding to a setting 'AUTO' with which it is automatically determined whether the daylight saving time is to be implemented in accordance with the setting information stored in the daylight saving time setting storage unit 431 (and the daylight saving time setting storage unit 142), a setting 'ON' with which the daylight saving time is set to be implemented irrespective of the setting information and a setting 'OFF' with which the daylight saving time is set not to be implemented irrespective of the setting information.

In the area setting storage unit 432, settings of a predetermined number of cities, which include at least the city currently selected in the electronic timepiece 40, of the respective settings in the plurality of cities stored in the area setting storage unit 143 are stored. The predetermined number of values to be storable is determined in correspondence to a capacity of the RAM 43 of the electronic timepiece 40 and the like, and may be '1' indicating only a currently selected city or may be '2' to '4', considering the number of business trip cities, for example. Here, a case where only a setting relating to one city corresponding to the current position is stored is described.

The data stored in the daylight saving time setting storage units 431, 142 and the area setting storage units 432, 143 is respectively attached with version information (information indicating an update situation), here, a four-digit version number such as '0003': For the version number, values of a finite range may be repeatedly used.

Here, according to the electronic timepiece 40, the user can manually change the DST setting by an input operation on the operation unit 47. Thereby, when the information as to whether the daylight saving time is to be implemented and the implementation time period of the daylight saving time is abruptly changed, so that the daylight saving time information does not correspond to the latest information or when the user wants to intentionally switch, display and use whether or not to reflect the implementation of the daylight saving time at the current position, the user can manually switch whether the daylight saving time is to be implemented. Also, the user can manually activate the local time setting managing application 141 by an input operation on the operation unit 18 of the smart phone 10 and transmit a command to change the DST setting to the electronic timepiece 40.

Subsequently, an update operation of the daylight saving time setting that is to be executed in the communication system 1 of the illustrative embodiment is described.

In the communication system 1, the smart phone 10 connects to the external data server 90 at a preset interval and acquires the data of the time zone setting and daylight saving time implementation setting (hereinafter, collectively referred to as local time setting). When there is a difference between the currently kept data in the daylight saving time setting storage unit 142 and the area setting storage unit 143 and the acquired data, '1' is added to the version number, so that the latest acquired data is stored. The smart phone 10 can connect to the external network (Internet) through the base station or the access point in many time slots and the connection interval can be flexibly set. However, the smart phone preferably connects to the external network at least two times in a year, for example, before the springtime (March to April, September to October) at which the daylight saving time starts in the Northern Hemisphere and the Southern Hemisphere, respectively. Also, the connection interval is not necessarily equal. For example, the smart phone may intensively connect to the external network several times in the springtime, respectively. In this way, the local time setting is acquired at appropriate timing and interval from the external data server 90 through the Internet, so that it is possible to easily keep the latest or substantially latest daylight saving time implementation information in the smart phone 10.

Although the update of the setting data of the daylight saving time setting storage unit 142 and the area setting storage unit 143 is not particularly limited, the update is performed according to a following policy. First, (1) when the implementation time period of the daylight saving time in some cities is changed to the same implementation time period being already implemented in the other city, the DST numbers associated with some cities in the area setting storage unit 143 are changed. Then, (2) when the implementation time period of the daylight saving time is changed in all cities in which the daylight saving time is implemented during the implementation time period relating to one DST number, the setting content of the DST number stored in the daylight saving time setting storage unit 142 is changed. (3) When the implementation time period of the daylight saving time in some cities is changed to a new time period different from the implementation time period for which the daylight saving time is implemented in the other city, a setting of the new implementation time period is additionally stored in the preliminary memory of the daylight saving time setting storage unit 142, so that the DST numbers associated with some cities in the area setting storage unit 143 are changed to the DST number of the preliminary memory.

In the meantime, at the preset timing and/or by a predetermined user input operation on the operation unit 47 of the electronic timepiece 40, the communication connection is made between the electronic timepiece 40 and the smart phone 10 and the date and time data is transmitted from the smart phone 10 to the electronic timepiece 40, so that the date and time of the timer unit 46 is corrected. At this time, when the data (the local time setting) of the daylight saving time setting storage unit 431 and the area setting storage unit 432 kept in the electronic timepiece 40 is different from the data of the daylight saving time setting storage unit 142 and the area setting storage unit 143 stored in the smart phone 10, or when the current position (city) specified with the smart phone 10 is different from the position set with the electronic timepiece 40, the data of the daylight saving time setting storage unit 142 and the area setting storage unit 143 is transmitted from the smart phone 10 together with the version number, so that the local time setting of the electronic timepiece 40 is updated.

Figure 5:
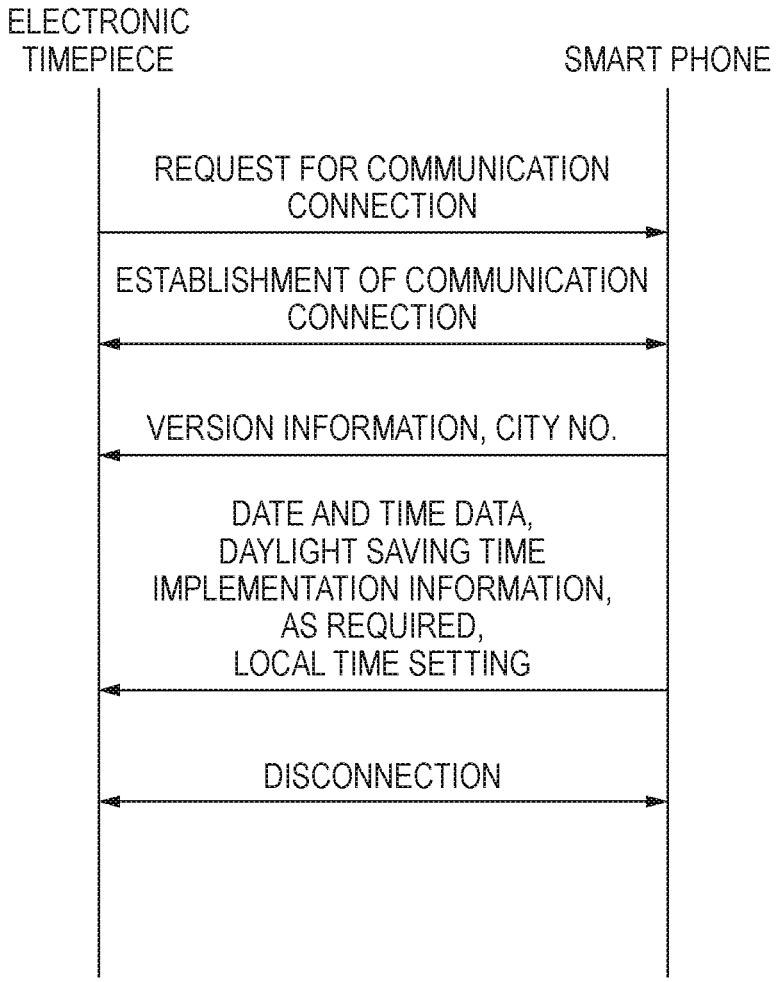
FIG. 5 is a sequence diagram depicting a communication sequence between the electronic timepiece and the smart phone.

FIG. 5 is a sequence diagram depicting a communication sequence between the electronic timepiece 40 and the smart phone 10.

In an update operation of the daylight saving time setting that is to be executed in the communication system 1 of the illustrative embodiment, the electronic timepiece 40 transmits a request for communication connection to the smart phone 10 by the Bluetooth. The smart phone 10 receives the request, responds to the electronic timepiece 40 and establishes communication connection.

The electronic timepiece 40 transmits the version information and the city number of the currently set city of the setting data (the local time setting) in the daylight saving time setting storage unit 431 and the area setting storage unit 432 to the smart phone 10. The smart phone 10 transmits to the electronic timepiece 40 the date and time counted by the built-in clock 15 and the date and time information (the local time) corresponding to the current position of the smart phone 10, and also transmits the setting data when the received version information is different from the version of the setting data of the daylight saving time setting storage unit 142 and the area setting storage unit 143. Also, when the current positions of the smart phone 10 and the electronic timepiece 40 are different from each other, the data, which corresponds to the current position of the smart phone 10, of the setting data of the area setting storage unit 143 is transmitted. Thereafter, the connection between the electronic timepiece 40 and the smart phone 10 is disconnected.

Figure 6:
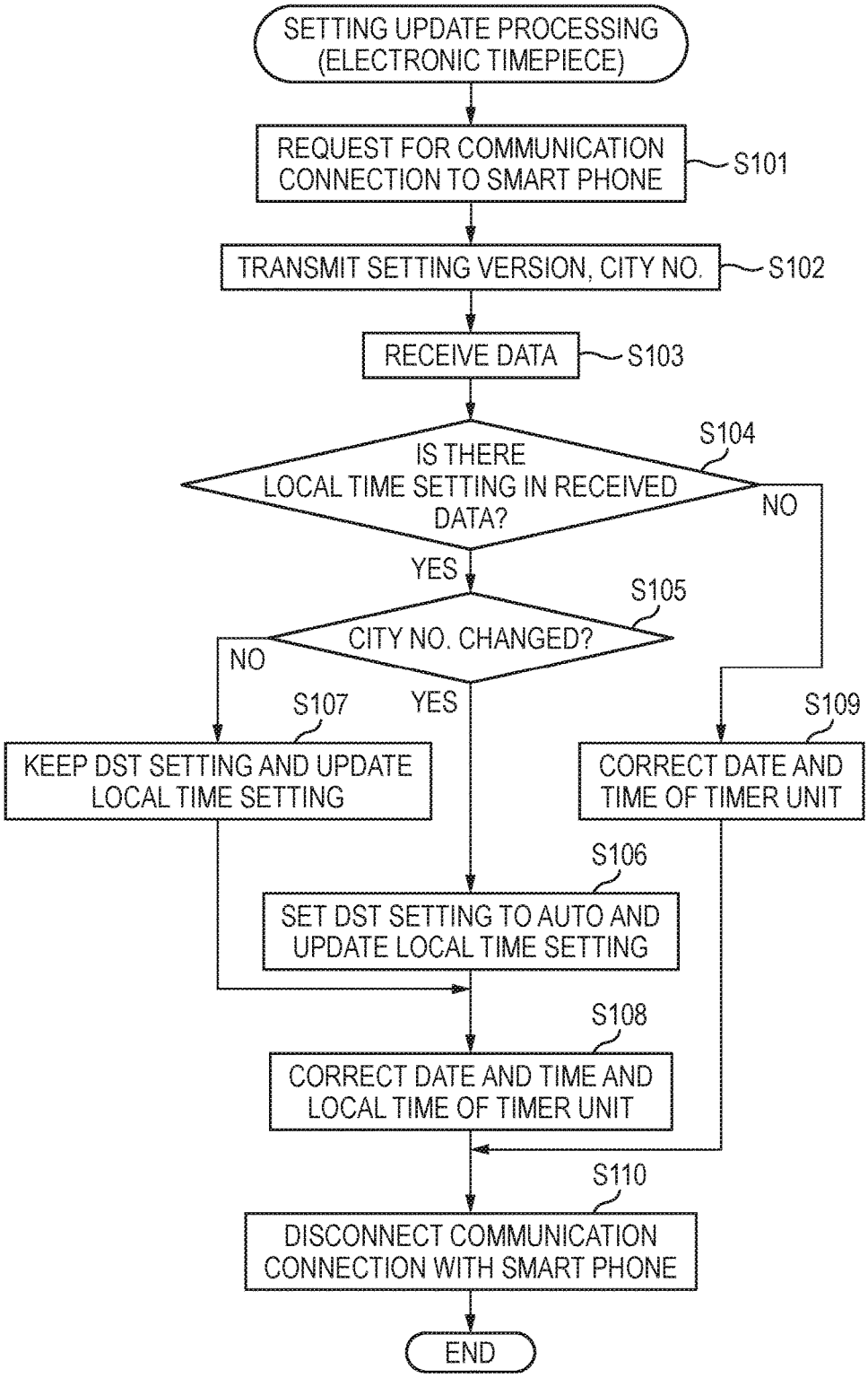
FIG. 6 is a flowchart depicting a control sequence of setting update processing that is to be executed in the electronic timepiece.

FIG. 6 is a flowchart depicting a control sequence of setting update processing that is to be executed in the electronic timepiece 40 by the CPU 41.

The setting update processing is automatically activated at a preset start time and/or is activated in correspondence to a predetermined user input operation on the operation unit 47. When the setting update processing starts, the CPU 41 outputs a request for communication connection from the Bluetooth module 48 to the smart phone 10 by the Bluetooth (step S101).

When the communication connection with the smart phone 10 is established, the CPU 41 transmits the version information of the setting data of the daylight saving time setting storage unit 431 and the area setting storage unit 432 and the city number included in the setting data of the area setting storage unit 432 from the Bluetooth module 48 to the smart phone 10 (step S102).

The CPU 41 stands by for data transmission from the smart phone 10 and receives data from the smart phone 10 (step S103). The CPU 41 determines whether the data received from the smart phone 10 includes the local time setting in addition to the date and time information (step S104). When it is determined that the local time setting is included ("YES" in step S104), the CPU 41 determines whether the city number has been changed from the currently set city number in the acquired local time setting (step S105). When it is determined that the city number has been changed ("YES" in step S105), the CPU 41 switches the DST setting to 'AUTO' and updates the daylight saving time setting storage unit 431 and/or the area setting storage unit 432 by using the setting data relating to the acquired local time setting (step S106). Then, the processing of the CPU 41 proceeds to step S108. When it is determined that the city number has not been changed ("NO" in step S105), the CPU 41 keeps the DST setting as it is, and updates the changed parts of the daylight saving time setting storage unit 431 and/or the area setting storage unit 432 (step S107). Then, the processing of the CPU 41 proceeds to step S108.

In the meantime, when the smart phone 10 determines whether the city numbers are different and transmits the corresponding DST setting, the CPU 41 may update the daylight saving time setting storage unit 431 and/or the area setting storage unit 432 without executing the determination processing of step S105.

When the processing proceeds to step S108, the CPU 41 corrects the date and time (the reference date and time) of the timer unit 46 based on the acquired date and time information, and calculates the local time based on the local time setting (step S108). Then, the processing of the CPU 41 proceeds to step S110.

When it is determined in the determination processing of step S104 that the local time setting is not included in the reception data ("NO" in step S104), the CPU 41 corrects the date and time of the timer unit 46 based on the received date and time data (step S109). The local time is corrected in correspondence to the correction of the date and time of the timer unit 46. Then, the processing of the CPU 41 proceeds to step S110.

In the meantime, the determination as to whether or not the local time setting is appropriately made when the local time setting is not received within a predetermined time period, when a predetermined header relating to transmission of the local time setting is followed by transmission of empty data or when a signal explicitly indicating that the local time setting is not transmitted is transmitted, for example.

When the processing proceeds to step S110, the CPU 41 disconnects the communication connection with the smart phone 10 by the Bluetooth (step S110). Then, the CPU 41 ends the setting update processing.

Figure 7:
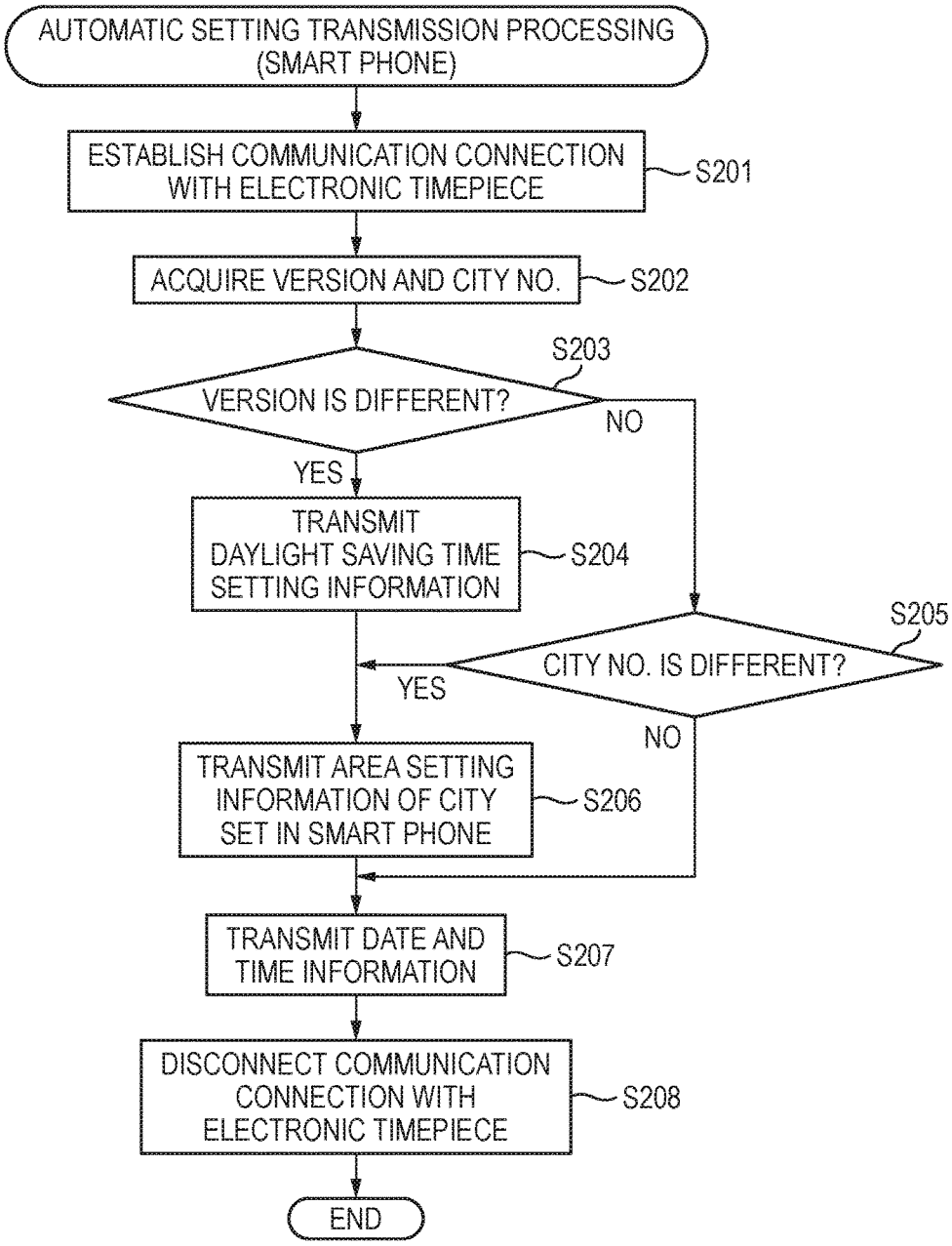
FIG. 7 is a flowchart depicting a control sequence of automatic setting transmission processing that is to be executed in the smart phone.

FIG. 7 is a flowchart depicting a control sequence of automatic setting transmission processing that is to be executed in the smart phone 10 by the CPU 11.

The automatic setting transmission processing starts when a request for communication connection is received from the electronic timepiece 40.

The CPU 11 firsts responds to the electronic timepiece 40 through the Bluetooth module 24 and establishes the communication connection with the electronic timepiece 40 (step S201). The CPU 11 acquires the version information and city number of the local time setting information transmitted from the electronic timepiece 40 (step S202).

The CPU 11 determines whether the version acquired from the electronic timepiece 40 is different from the version of the information stored in the daylight saving time setting storage unit 142 and the area setting storage unit 143 (step S203). When it is determined that the versions are different ("YES" in step S203), the CPU 11 transmits the daylight saving time setting information of at least a part (a different part), which has been changed due to the version difference, of the local time setting information to the electronic timepiece 40 through the Bluetooth module 24 (step S204). Then, the processing of the CPU 11 proceeds to step S206.

Here, in step S204, when transmitting only the daylight saving time setting information of the changed part due to the version difference, the CPU 11 may prepare difference data in advance in which the changed part is collected, upon the update of the daylight saving time setting information.

When it is determined that the versions are not different ("NO" in step S203), the CPU 11 determines whether the acquired city number is different from the number of the city currently set in the smart phone 10 (step S205, the movement determination unit 112). When it is determined that the city numbers are different ("YES" in step S205), the processing of the CPU 11 proceeds to step S206. When it is determined that the city numbers are not different (are the same) ("NO" in step S205), the processing of the CPU 11 proceeds to step S207.

When the processing proceeds to step S206, the CPU 11 reads out the area setting information of the city relating to the city number set in the smart phone 10 from the area setting storage unit 143 and transmits the same to the electronic timepiece 40 through the Bluetooth module 24 (step S206). Then, the processing of the CPU 11 proceeds to step S207.

In the meantime, as described above, when the processing of step S105 is omitted in the setting update processing of the electronic timepiece, it is necessary for the CPU 11 to appropriately set and transmit the DST setting in the processing of step S206.

When the processing proceeds to step S207, the CPU 11 transmits the date and time information (the local time) to the electronic timepiece 40 through the Bluetooth module 24 (step S207). Then, the CPU 11 disconnects the communication connection with the electronic timepiece 40 through the Bluetooth module 24 (step S208). Thereafter, the CPU 11 ends the automatic setting transmission processing.

Figure 8:
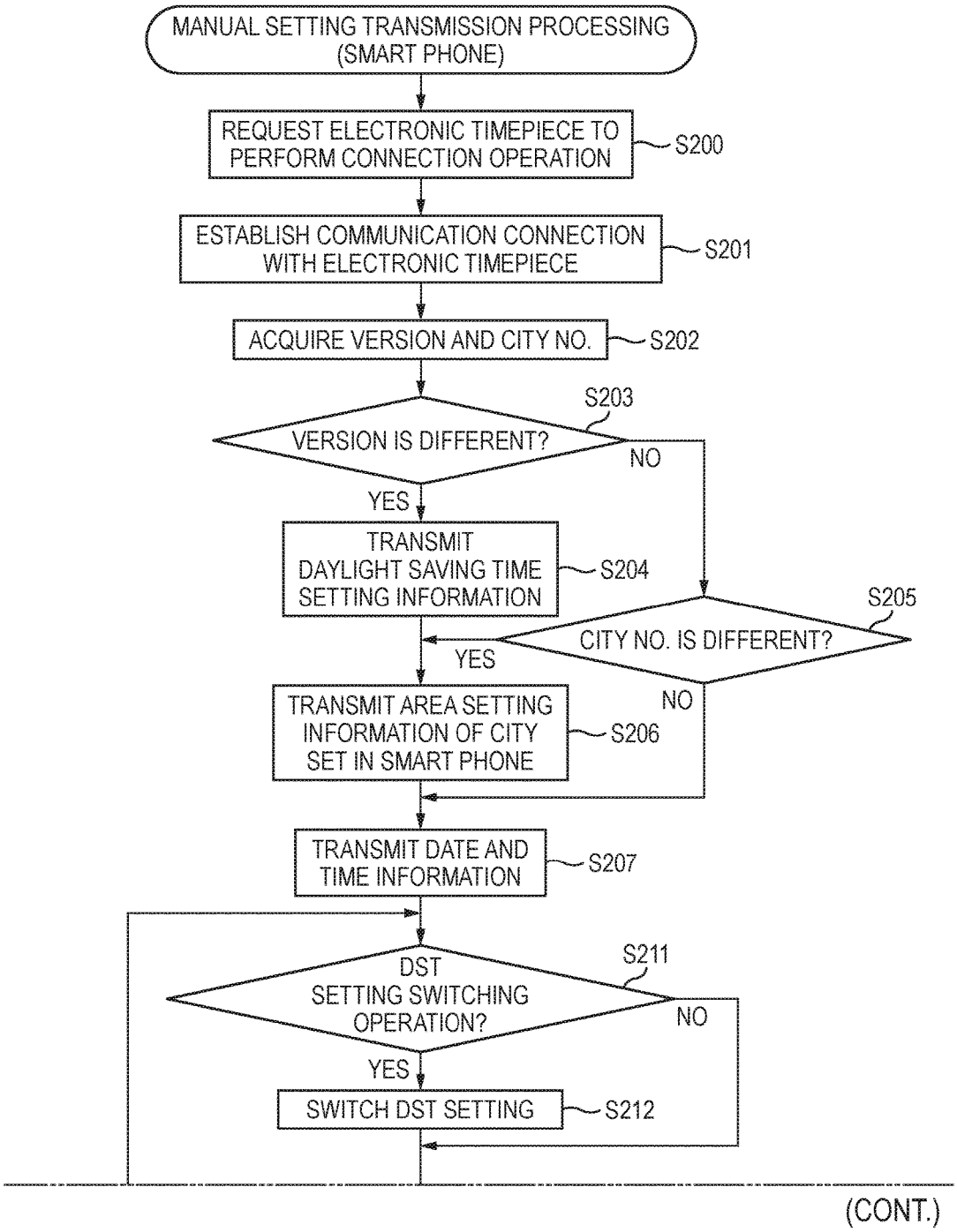
FIG. 8 is a flowchart depicting a control sequence of manual setting transmission processing that is to be executed in the smart phone.

FIG. 8 is a flowchart depicting a control sequence of manual setting transmission processing that is to be executed in the smart phone 10 by the CPU 11 when the update operation of the daylight saving time setting is manually performed in correspondence to the operation on the smart phone 10.

The manual setting transmission processing is the automatic setting transmission processing to which processing of steps S200 and S211 to S215 is added, and the other processing is the same. Therefore, the same processing is denoted with the same reference numerals and the detailed descriptions thereof are omitted.

The manual setting transmission processing starts when the local time setting managing application 141 is activated in the smart phone 10 and an operation relating to a connection command with the electronic timepiece 40 is performed in the display screen.

When the manual setting transmission processing starts, the CPU 11 transmits a request for connection operation to the electronic timepiece 40 through the Bluetooth communication (step S200). The CPU 11 establishes the communication connection with the electronic timepiece in correspondence to communication from the electronic timepiece 40 (step S201).

Also, the CPU 11 transmits the date and time information in the processing of step S207 and then determines whether a switching operation of the DST setting is detected (step S211). When it is determined that the switching operation is detected ("YES" in step S211), the CPU 11 changes the DST setting to the switching destination (step S212). Then, the processing of the CPU 11 proceeds to step S213. When it is determined that the switching operation of the DST setting is not detected ("NO" in step S211), the processing of the CPU 11 proceeds to step S213.

When the processing proceeds to step S213, the CPU 11 determines whether an operation relating to a transmission command of the DST setting is detected (step S213). When it is determined that the operation is detected ("YES" in step S213), the CPU 11 transmits the DST setting set at that time to the electronic timepiece 40 through the Bluetooth module 24 (step S214). Then, the processing of the CPU 11 proceeds to step S215. When it is determined that the operation is not detected ("NO" in step S213), the processing of the CPU 11 proceeds to step S215.

When the processing proceeds to step S215, the CPU 11 determines whether an ending operation of the local time setting is detected (step S215). When it is determined that the ending operation is detected ("YES" in step S215), the CPU 11 ends the manual setting transmission processing. When it is determined that the ending operation is not detected ("NO" in step S215), the CPU 11 returns to step S211.

Figure 9:
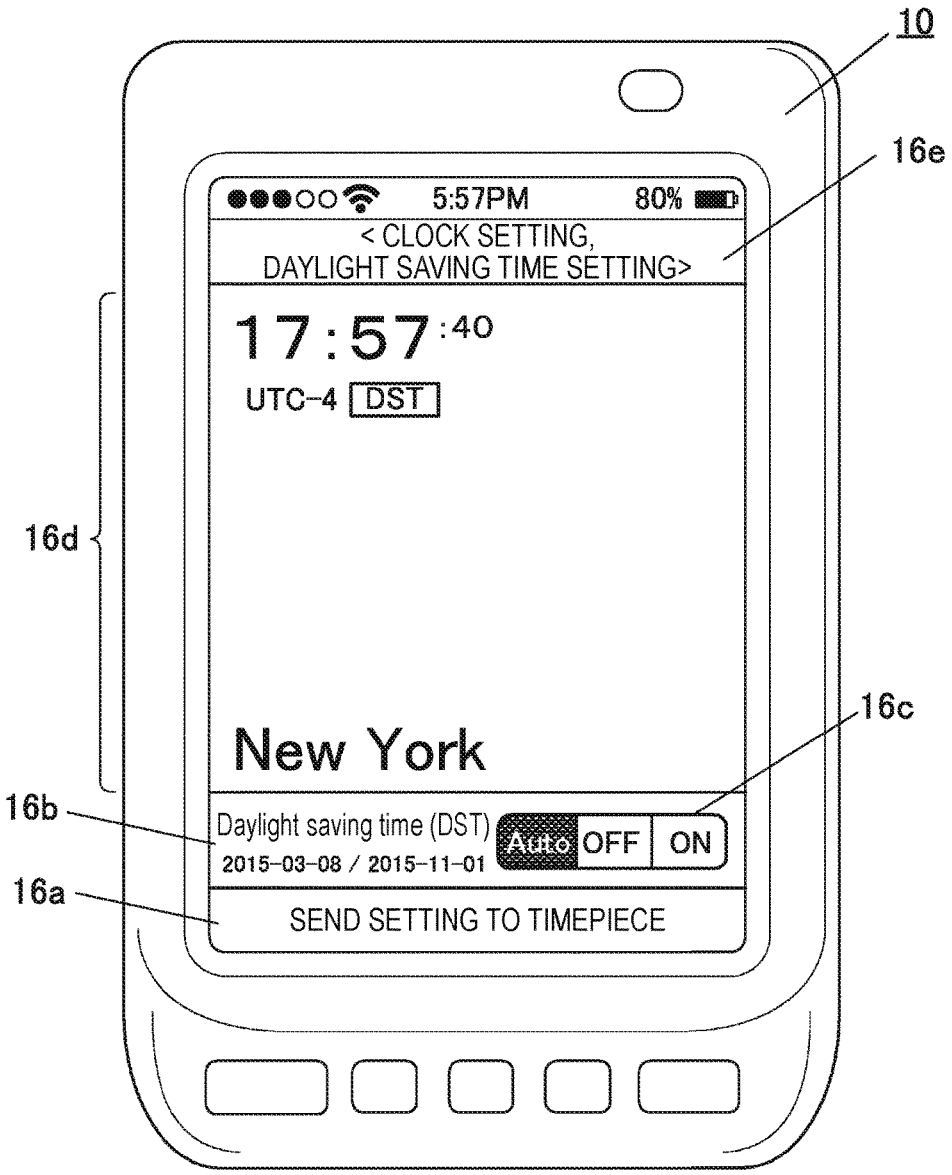
FIG. 9 depicts a display example on a display screen of the smart phone.
Figure 10:
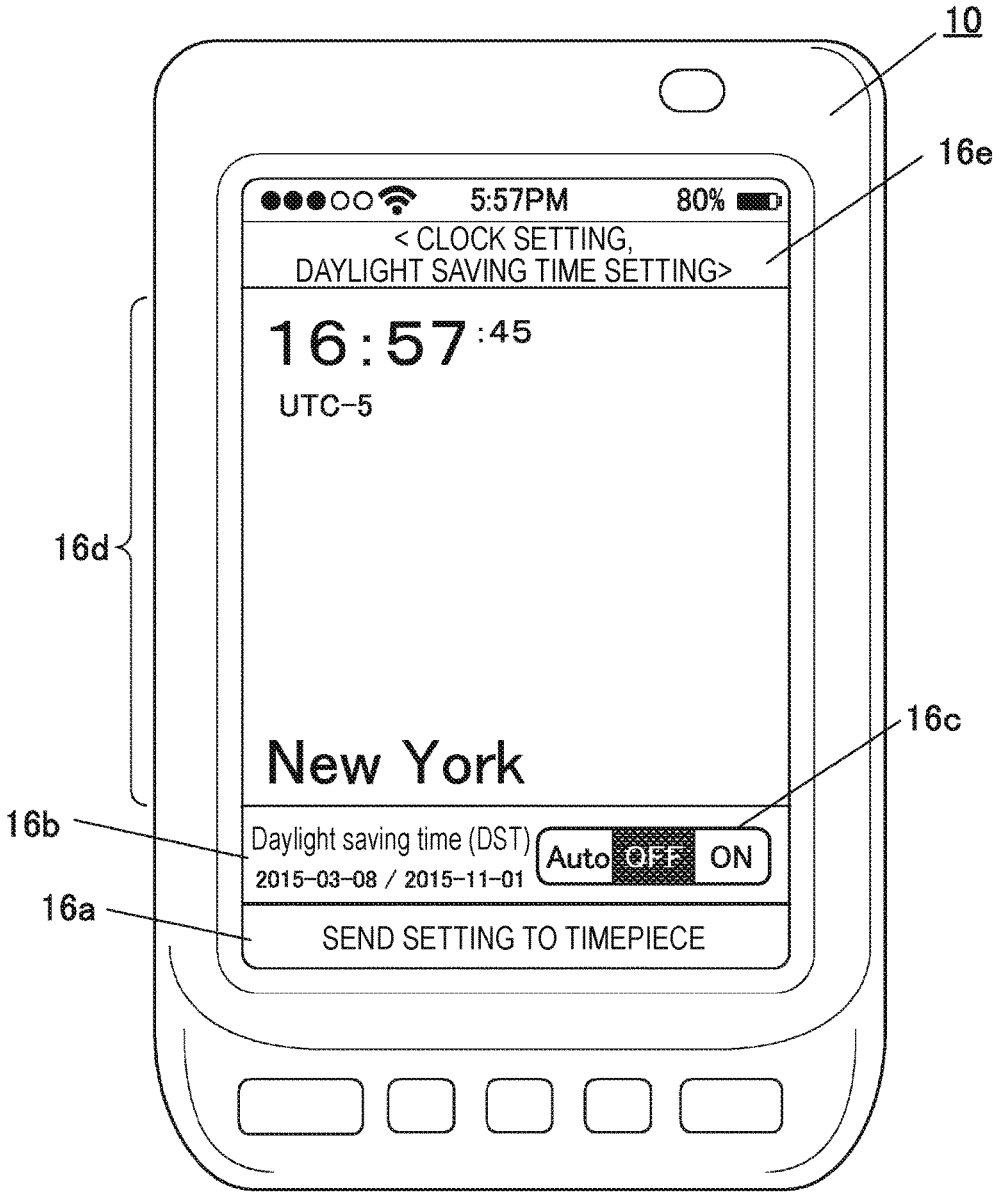
FIG. 10 depicts a display example on the display screen of the smart phone.

FIGS. 9 and 10 depict display examples on the display screen of the smart phone 10 when the local time setting managing application is manually executed.

As shown in FIG. 9, the display unit 16 of the smart phone 10 displays a current local time, a time difference from the UTC and a city name indicating a current position at a central portion 16*d* on the display screen. Here, it is indicated that DST is being implemented in New York and the current local time is 17:57:40 with a time difference of UTC−4 hours. At a lower end of the central portion 16*d*, an implementation time period display 16*b* of the daylight saving time set for New York and a selection screen 16*c* of the DST setting are displayed. Here, the DST setting is AUTO, and 'AUTO' is highlighted in the selection screen 16*c* of the DST setting. Also, it is indicated that the time difference is calculated based on the daylight saving time implementation time period from Mar. 8, 2015 to Nov. 1, 2015, in correspondence to the AUTO setting.

At a lower end portion of the display screen, a display 16*a* of receiving a command to transmit the DST setting to the electronic timepiece 40 is indicated. When a touch operation (tapping) in the display 16*a* is performed, the determination processing of step S213 in FIG. 8 proceed to "YES." In the meantime, at an upper end portion 16*e* of the display screen, a state of currently performing the daylight saving time setting is indicated. When the user proceeds to a higher layer, it is possible to exit from the operation relating to the daylight saving time setting. Alternatively, the user may directly end the operation program of the local time setting application.

At the display state of FIG. 9, when OFF is selected as the DST setting in the selection screen 16*c* of the DST setting, the selected 'OFF' is highlighted, as shown in FIG. 10. In the central portion 16*d*, a time difference based on the non-implementation of DST and time calculated by the time difference are displayed. That is, the local time becomes UTC−5 hours, and 16:57:45, which is earlier than the usual local time (5:57 PM) indicated at the upper end of the display screen, is displayed as the local time.

Figure 11:
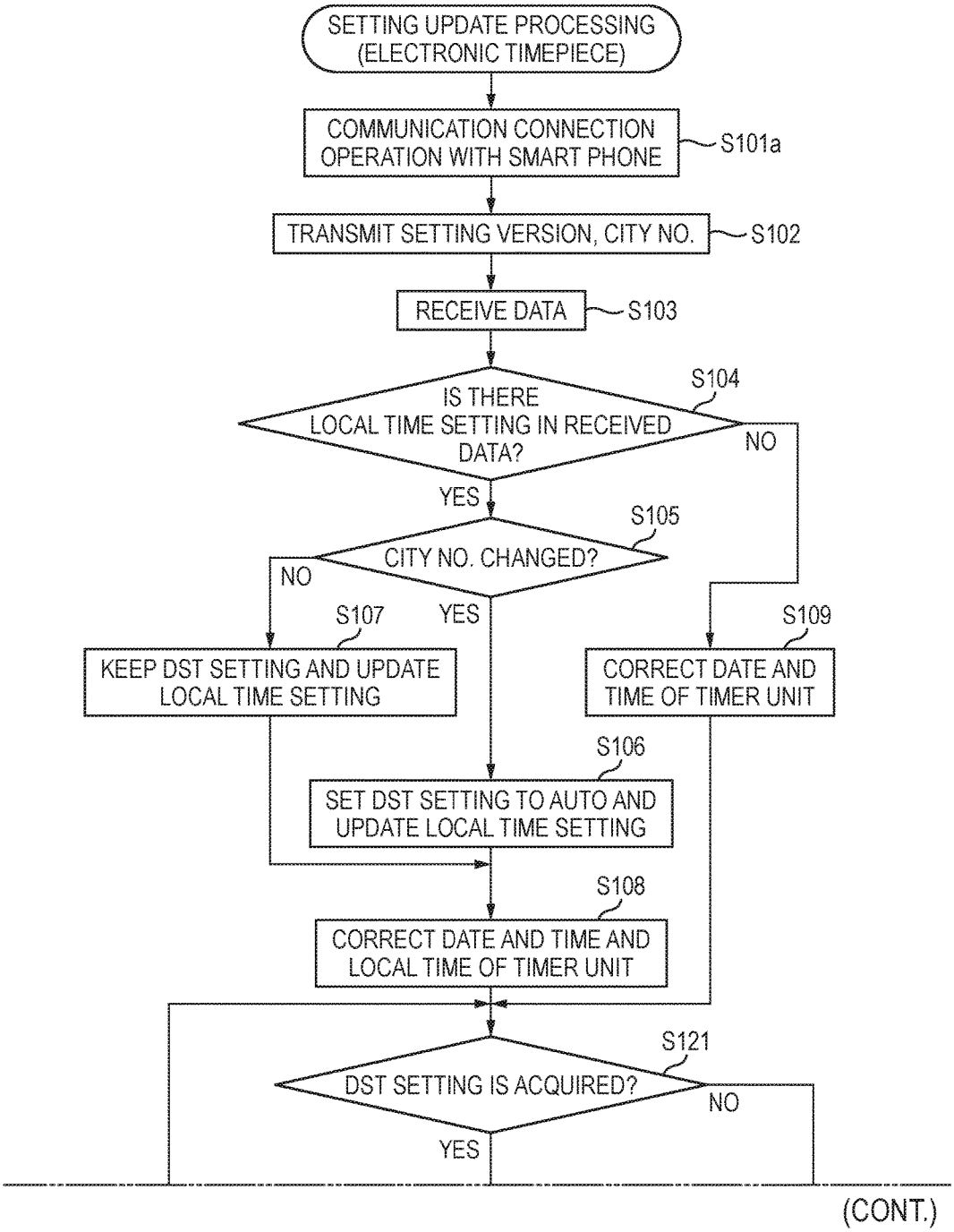
FIG. 11 is a flowchart depicting a control sequence of the setting update processing that is to be executed in the electronic timepiece, in correspondence to the manual setting transmission processing.

FIG. 11 is a flowchart depicting a control sequence of the setting update processing that is to be executed in the electronic timepiece 40 by the CPU 41 when the update operation of the daylight saving time setting is manually performed in correspondence to the operation of the smart phone 10.

As described above, the setting update processing starts when the smart phone 10 issues the request for connection operation. In the setting update processing, the processing of step S101 of the setting update processing shown in FIG. 6 is replaced with processing of step S101*a*, and processing of steps S121 to S123 is added. The other processing is the same, the same processing is denoted with the same reference numerals and the detailed descriptions thereof are omitted.

When the setting update processing starts, the CPU 41 makes a communication connection operation with the smart phone 10 and establishes the communication connection (step S101*a*). Then, the processing of the CPU 41 proceeds to step S102.

Also, when the processing of steps S108, S109 is over, the CPU 41 determines whether the data relating to the DST setting is acquired in the local time setting or separately (step S121). When it is determined that the DST setting is acquired ("YES" in step S121), the CPU 41 again calculates the local time in correspondence to the changed DST setting (step S122). Then, the processing of the CPU 41 proceeds to step S123. When it is determined that the DST setting is not acquired ("NO" in step S121), the processing of the CPU 41 proceeds to step S123.

When the processing proceeds to step S123, the CPU 41 determines whether a request for communication disconnection with the smart phone 10 is received (step S123). This determination processing includes a determination as to whether or not to perform post-processing when the communication is unilaterally disconnected by the smart phone 10. When it is determined that the disconnection request is received (it is necessary to perform the post-processing after the disconnection) ("YES" in step S123), the CPU 41 executes processing relating to the disconnection of the communication connection with the smart phone 10 (step S108). Then, the CPU 41 ends the setting update processing. When it is determined that the disconnection request is not received (it is not necessary to perform the post-processing after the disconnection) ("NO" in step S123), the processing of the CPU 41 returns to step S121.

In the meantime, when it is necessarily required to make the Bluetooth communication connection at the electronic timepiece 40, the setting update processing may be activated at the electronic timepiece 40 by the user input operation on the operation unit 47 at a state where the user activates the local time setting managing application 141 at the smart phone 10, thereby transmitting a request for communication connection to the smart phone 10. In this case, the communication is not immediately disconnected after the date and time information and the local time setting are acquired at the electronic timepiece 40 by the signal from the smart phone 10.

As described above, the electronic timepiece 40 of the illustrative embodiment includes the timer unit 46 configured to count the local time at the current position, the daylight saving time setting storage unit 431 configured to store therein the daylight saving time implementation information at least at the current position, the CPU 41, the Bluetooth module 48 configured to perform communication with the smart phone 10, which is an external device, and the like. The CPU 41 is configured, as the daylight saving time correction unit 410, to correct the local time in correspondence to the implementation situation of the daylight saving time at the current position, based on the daylight saving time implementation information, and is configured, as the setting update unit 411, to acquire the update information of the daylight saving time implementation information from the smart phone 10 through the Bluetooth module 48 and to reflect the same in the daylight saving time implementation information of the daylight saving time setting storage unit 431.

In this way, the daylight saving time setting is kept in the electronic timepiece 40, so that upon the switching of the daylight saving time setting, it is possible to rapidly correct the local time with respect to the switching. Also, even when the daylight saving time setting is updated, it is possible to easily acquire the update information from the smart phone 10 and to reflect the same in the kept daylight saving time setting. As a result, it is possible to easily keep the counting of the correct local time even in the electronic timepiece 40 with which it is not easy to change the daylight saving time setting. Also, since it is possible to obtain the necessary setting from the smart phone 10, it is not necessary to provide many marks for settings on the dial plate, the housing and the like of the electronic timepiece 40, so that it is possible to diversely design of the electronic timepiece 40.

Also, the CPU 41 is configured, as the date and time information acquisition unit 412, to acquire the date and time information from the smart phone 10 and is configured, as the time correction unit 416, to correct the local time, which is to be counted by the timer unit 46, based on the acquired date and time information. Also, the update information of the daylight saving time implementation information is acquired together with the date and time information. That is, upon the acquisition of the date and time information that is frequently performed such as one time per at least one day so as to correctly keep the date and time that is to be counted and displayed at the electronic timepiece 40, it is also possible to update the daylight saving time implementation information, so that it is possible to easily keep the latest daylight saving time implementation information. Therefore, it is possible to reduce a possibility that the local time will be counted and displayed in correspondence to the wrong daylight saving time.

Also, the CPU 41 is configured, as the local time setting acquisition unit 414, to acquire the local time setting relating to the counting of the local time at the current position from the smart phone 10, and the implementation time period of the daylight saving time that is implemented in the world is stored in the daylight saving time setting storage unit 431, as the daylight saving time implementation information. The CPU 41 is configured, as the daylight saving time correction unit 410, to select the implementation time period of the daylight saving time at the current position from the daylight saving time implementation information, based on the acquired local time setting, and to correct the local time in accordance with the implementation time period. Therefore, it is possible to easily count the correct local time reflecting the daylight saving time without increasing the communication traffic beyond necessity by acquiring only the information for selecting the daylight saving time implementation time period corresponding to the current position from the smart phone 10 while keeping the daylight saving time setting, which is not frequently changed, in the electronic timepiece 40.

Also, the update information of the daylight saving time implementation information is acquired together with the local time setting, so that it is also possible to acquire the correct daylight saving time implementation information upon the change and correction of the local time to be calculated, thereby securely obtaining the correct local time.

Also, the local time setting includes the information of the time zone to which the current position belongs, and the timer unit 46 is configured, as the reference date and time counting unit, to count the reference date and time, and is configured, as the local time conversion unit, to calculate the local time based on the time difference from the reference date and time in the acquired time zone.

Therefore, when setting and displaying the world time (world time clock) only by the electronic timepiece 40, it is possible to easily calculate the local time of a different time zone based on the information of the time zone.

Also, the operation unit 47 configured to receive the user input operation is provided, and the CPU 41 is configured, as the daylight saving time applying selection unit 415, to switch whether the daylight saving time correction unit 410 corrects the local time in correspondence to whether or not the implementation of the daylight saving time, which is set based on the input operation on the operation unit 47, or corrects the local time in correspondence to the implementation situation of the daylight saving time at the current position obtained based on the daylight saving time implementation information.

Therefore, usually, even when the user does not care about the implementation situation of the daylight saving time, the local time is appropriately corrected in correspondence to the implementation situation of the daylight saving time. Also, when the user does not intentionally want to display the daylight saving time or when the daylight saving time is abruptly implemented or cancelled and the manual switching is temporarily simpler, the user can switch the DST setting by the input operation on the operation unit 47.

Also, the local time setting includes the information indicative of the current position. When the acquired current position and the setting position set as the current position upon the acquisition of the current position are different from each other, the CPU 41 functioning as the daylight saving time applying selection unit 415 corrects the local time in correspondence to the implementation situation of the daylight saving time at the current position obtained based on the daylight saving time implementation information, and when the current position and the setting position are the same and the set setting as to whether or not to implement the daylight saving time is set based on the user input operation, the CPU 41 corrects the local time in correspondence to the setting as to whether or not to implement the daylight saving time. Therefore, even though the user is manually switching the DST setting, when the user moves to the other time zone or daylight saving time implementation area, it is possible to avoid a situation where the user does not know whether the daylight saving time is appropriately reflected in the display time of the corresponding area. Also, the change setting and the like of the local temporary daylight saving time implementation time period are not unnecessarily reflected in the other areas.

Also, the communication system 1 of the illustrative embodiment of the disclosure includes the electronic timepiece 40 having the Bluetooth module 48 and the smart phone 10 having the Bluetooth module 24 and the electronic timepiece 40 and the smart phone 10 can perform communication with each other through the Bluetooth module 48 and the Bluetooth module 24. The electronic timepiece 40 includes the timer unit 46 configured to count the local time at the current position, the daylight saving time setting storage unit 431 configured to store therein the daylight saving time implementation information at least at the current position and the CPU 41, and the CPU 41 is configured, as the daylight saving time correction unit 410, to correct the local time in correspondence to the implementation situation of the daylight saving time at the current position based on the daylight saving time implementation information and is configured, as the setting update unit 411, to acquire the update information of the daylight saving time implementation information from the smart phone 10 through the Bluetooth module 48 and to reflect the same in the daylight saving time implementation information. Also, the smart phone 10 includes the daylight saving time setting storage unit 142 configured to store therein the implementation time period of the daylight saving time, which is to be implemented in the world, as the daylight saving time implementation information and the CPU 11, and the CPU 11 is configured, as the update information transmission control unit 110, to transmit the daylight saving time implementation information at least at the current position of the daylight saving time implementation information stored in the daylight saving time setting storage unit 142 to the electronic timepiece 40 through the Bluetooth module 24, as the update information.

That is, even though the electronic timepiece 40 is not connected to the smart phone 10 all the time, the electronic timepiece 40 can correct the local time with respect to the implementation situation of the daylight saving time at the appropriate timing and the shift time based on the daylight saving time implementation information stored in the daylight saving time setting storage unit 431 and easily acquire the update information relating to the change in the daylight saving time implementation information from the smart phone 10, so that it is possible to cope with the change in the daylight saving time implementation time period and the like. Therefore, it is possible to easily keep the counting of the correct local time in the electronic timepiece 40 without bothering the user. In particular, the smart phone 10 or the mobile phone is used as the electronic device that is to be communication-connected to the electronic timepiece 40. Therefore, it is possible to prolong the time for which it is kept by the user together with the electronic timepiece 40, so that it is possible to easily and frequently acquire the date and time information, the local time setting and the update information.

Also, since the electronic device has the higher operability, the larger capacities of the battery and the memory and the higher processing ability of the CPU than the electronic timepiece 40, it is possible to more easily count the daylight saving time in which the latest daylight saving time implementation time period is reflected, as compared to a configuration where the electronic timepiece 40 directly updates the daylight saving time implementation information. In the meantime, since the electronic timepiece 40 is not directly connected to the Internet to acquire the daylight saving time implementation information, it is not necessary to provide the electronic timepiece 40 with a configuration for Internet connection, a battery and the like, so that it is possible to prevent the electronic timepiece 40 from being enlarged and to suppress the increase in the weight and/or the power consumption.

Also, in the smart phone 10, the CPU 11 is configured, as the update applying determination unit 111, to determine whether the daylight saving time implementation information stored in the daylight saving time setting storage unit 431 of the electronic timepiece 40 is the same as the corresponding information of the daylight saving time implementation information stored in the daylight saving time setting storage unit 142 of the smart phone 10. Also, when it is determined that the daylight saving time implementation information of the electronic timepiece 40 is not the same as the corresponding part of the daylight saving time implementation information of the smart phone 10, the CPU 11 configured to function as the update information transmission control unit 110 transmits the daylight saving time implementation information at least at the current position to the electronic timepiece 40 through the Bluetooth module 24, as the update information.

Therefore, since the update information is transmitted only in the necessary situation such as a case where the daylight saving time implementation information relating to the necessary daylight saving time implementation time period is changed or updated or is not kept in the electronic timepiece 40, it is possible to quickly keep only the necessary information in the electronic timepiece 40 without unnecessarily repeatedly transmitting the changeless daylight saving time implementation information.

Also, the local time setting managing application 141 of the illustrative embodiment of the disclosure is configured to enable a computer of the smart phone 10 having the Bluetooth module 24, which is configured to perform communication with the electronic timepiece 40, to function as the daylight saving time setting storage unit 142 configured to store therein the implementation time period of the daylight saving time that is to be implemented in the world, as the daylight saving time implementation information, and to function as the update information transmission control unit 110 configured to transmit the daylight saving time implementation information at least at the current position of the daylight saving time implementation information stored in the daylight saving time setting storage unit 142 to the electronic timepiece 40 through the Bluetooth module 24, as the update information.

The local time setting managing application 141 is installed and operated in the smart phone 10 and the like, so that it is possible to easily provide the electronic timepiece 40 with the appropriate daylight saving time implementation information and to enable the electronic timepiece 40 to count the correct local time.

Also, the computer of the smart phone 10 is configured to function as the update applying determination unit 111 configured to determine whether the daylight saving time implementation information kept in the electronic timepiece 40 is the same as the corresponding information of the daylight saving time implementation information stored in the daylight saving time setting storage unit 142. When it is determined by the update applying determination unit 111 that the information is not the same, the update information transmission control unit 110 transmits at least a part (changed part) of the daylight saving time implementation information, which is not the same between both the information, to the electronic timepiece 40 through the Bluetooth module 24, as the update information.

In this way, the smart phone 10 is configured to determine whether the daylight saving time implementation information kept in the electronic timepiece 40 is old, and transmits the update information only when the update information is necessary, such as a case where the daylight saving time implementation information relating to the daylight saving time implementation time period is changed or updated or is not kept in the electronic timepiece 40. Therefore, it is not necessary to enable the electronic timepiece 40 to perform the unnecessary data communication and it is possible to appropriately update the daylight saving time implementation information. Also, only the changed part is transmitted to the electronic timepiece 40, so that it is possible to further reduce the data communication traffic and to easily keep the counting of the correct local time in the electronic timepiece 40.

Also, the computer of the smart phone 10 is configured to function as the local time setting storage unit configured to store, as the local time setting, the selection information for selecting the implementation time period of the daylight saving time in each of the preset areas of the world from the daylight saving time implementation information, and to function as the local time setting transmission control unit configured to transmit the local time setting at the current position to the electronic timepiece 40 through the Bluetooth module 24. Upon the transmission of the local time setting at the current position through the Bluetooth module 24, when it is determined by the update applying determination unit 111 that the daylight saving time implementation information of the electronic timepiece 40 and the smart phone 10 is not the same, the update information transmission control unit 110 also transmits the daylight saving time implementation information at least at the current position of the daylight saving time implementation information stored in the daylight saving time setting storage unit 142 to the electronic timepiece 40.

That is, when the current position of the smart phone 10 is changed, the electronic timepiece 40 is easily switched to the counting of the local time relating to the changed current position, and when the daylight saving time implementation information corresponding to the local time of the switching destination is changed to the information after the information kept in the electronic timepiece 40, at least the daylight saving time implementation information is transmitted to the electronic timepiece 40. Thereby, it is not necessary for the electronic timepiece 40 to measure the current position or to enable the user to perform the input operation, and the electronic timepiece 40 can easily acquire the local time setting corresponding to the current position and count the local time. At this time, the latest daylight saving time implementation information corresponding to the current position is also transmitted as required. Therefore, the electronic timepiece 40 can also calculate the local time in which the daylight saving time corresponding to the latest daylight saving time implementation information is reflected.

Also, since the local time setting includes the shift time information that is to be shifted during the implementation time period of the daylight saving time, it is not required to include the shift time information in the daylight saving time implementation information, so that it is possible to reduce an amount of the data to be stored in the daylight saving time setting storage unit 431.

Also, since the local time setting includes the setting of the time zone corresponding to the current position, it is possible not only to correctly count the local time but also to enable the user of the electronic timepiece 40 to recognize the information of the set time zone. Also, when transmitting the local time setting from the smart phone 10 to the electronic timepiece 40, even though the time zone to which the current position belongs is also changed like the daylight saving time implementation information, the user can recognize whether the local time in which the change is correctly reflected has been calculated.

Also, the computer of the smart phone 10 is configured to function as the current position acquisition unit configured to acquire the current position and to function as the movement determination unit 112 configured to determine whether the acquired current position and the setting position set in the electronic timepiece 40 as the current position upon the acquisition are the same. When it is determined that the current position and the setting position are not the same, the local time setting transmission control unit transmits the local time setting to the electronic timepiece 40 through the Bluetooth module 24. In this way, regarding the local time setting, too, only when the user of the electronic timepiece 40 and the smart phone 10 moves, so that the time zone or the daylight saving time setting is changed, the local time setting is transmitted from the smart phone 10 to the electronic timepiece 40, so that it is possible to prevent the labor and the increase in the load of repeatedly transmitting the unnecessary information.

Also, when it is determined that the current position and the setting position are the same, the update information transmission control unit 110 keeps the switching setting as to whether to correct the local time in accordance with the daylight saving time implementation information in the electronic timepiece 40, as it is the setting in the electronic timepiece 40, and when it is determined that the current position and the setting position are not the same, the update information transmission control unit 110 sets the setting of correcting the local time in accordance with the daylight saving time implementation information in the electronic timepiece 40.

Therefore, even though the user is manually switching the DST setting at the electronic timepiece 40, when the user moves to the other time zone or daylight saving time implementation area, it is possible to avoid a situation where the user does not know whether the daylight saving time is appropriately reflected in the display time of the corresponding area. Also, the change setting and the like of the local temporary daylight saving time implementation time period are not unnecessarily reflected in the other areas.

Also, the movement determination unit 112 is configured to acquire the setting position by receiving the information relating to the setting position transmitted from the electronic timepiece 40 through the Bluetooth module 24 and. Therefore, even when the electronic device to be connected to the electronic timepiece 40 is a device rather than the smart phone 10, it is possible to easily determine the difference from the current position, to securely determine the movement and to enable the electronic timepiece 40 to correctly acquire the local time setting at the new current position.

Also, the computer of the smart phone 10 is configured to function as the update information acquisition unit configured to acquire the daylight saving time implementation information updated from the outside. Whenever the new daylight saving time implementation information is acquired, the update information acquisition unit generates the version number indicative of the update situation of the daylight saving time implementation information, and the update applying determination unit 111 compares the version number indicative of the update situation of the daylight saving time implementation information upon the transmission of the daylight saving time implementation information to the electronic timepiece 40 and the version number indicative of the update situation of the daylight saving time implementation information stored in the daylight saving time setting storage unit 142.

Thereby, since it is possible to easily determine when the update is made, what the update is made and which the update information has been transmitted to the electronic timepiece 40 at the smart phone 10, it is possible to easily determine whether the daylight saving time implementation information kept in the electronic timepiece 40 is latest or not and to transmit the update information, as required. In particular, the simple index such as the version information of the daylight saving time implementation information is used, so that it is possible to determine the update situation more easily.

Also, the information, which is indicative of the update situation of the daylight saving time implementation information when the daylight saving time implementation information is transmitted to the electronic timepiece 40, is received from the electronic timepiece 40 through the Bluetooth module 24. That is, since the electronic timepiece 40 keeps the update situation relating to the daylight saving time implementation information of the daylight saving time setting storage unit 431, it is possible to separately and securely manage the update situations of the electronic timepiece 40 and the smart phone 10, respectively, and to easily determine whether there is a difference.

Also, when the implementation time period is changed to the new implementation time period in some areas of the plurality of areas corresponding to the one implementation time period of the daylight saving time in the acquired daylight saving time implementation information, the update information acquisition unit makes an update of adding the new implementation time period to the daylight saving time setting storage unit 142, and when the implementation time period is changed to the new implementation time period in all areas corresponding to the one implementation time period in the acquired daylight saving time implementation information, the update information acquisition unit makes an update of overwriting the changed implementation time period in the daylight saving time setting storage unit 142.

In this way, the part that is to be additionally recorded with respect to the changed part is suppressed to be small, so that it is possible to efficiently store the same without increasing the memory capacity to be allotted to the daylight saving time setting storage unit 142 beyond necessity.

In the meantime, the disclosure is not limited to the above illustrative embodiment and can be diversely changed.

For example, in the above illustrative embodiment, the data of all the daylight saving time implementation time periods of the daylight saving time that is to be implemented in the world is kept in the electronic timepiece 40. However, only the necessary part may be kept. Also, even when all the data is kept, only the necessary part may be updated. In this case, the daylight saving time implementation information corresponding to the daylight saving time implementation time period to be newly applied may be acquired, irrespective of whether or not the update.

Also, in the above illustrative embodiment, when the date and time information is acquired from the smart phone 10, the daylight saving time implementation information is also acquired but may be separately acquired.

Also, in the above illustrative embodiment, the information of the shift time during the daylight saving time implementation time period is acquired as the local time setting but may be included in the daylight saving time implementation information. Also, regarding the time zone and the city information, all the data thereof may not be acquired from the smart phone 10 and only the parameter for referring to the data stored in the ROM 42 or the RAM 43 of the electronic timepiece 40 may be acquired.

Also, in the above illustrative embodiment, the local time setting is acquired from the smart phone 10. However, the electronic timepiece may be configured to acquire the information of the current position directly or from the outside and to set the local time from the table data kept therein in advance based on the current position.

Also, the current date and time that is to be acquired from the external device may be the local time at the current position or may be acquired as UTC date and time and the like. In this case, the electronic timepiece 40 may be configured to continuously count the acquired local time, to correct the date and time, which is to be counted by the timer unit 46, by converting the acquired local time into UTC date and time or internal counted value and then to again convert the date and time into the local time. Also, when the local time is acquired, only the daylight saving time implementation time period may be specified and the information such as the time zone and the current position may not be kept in the electronic timepiece 40.

Also, in the above illustrative embodiment, the DST setting can be switched by the user operation on the electronic timepiece 40 and the smart phone 10. However, the DST setting may be switched by the user operation on any one of the electronic timepiece 40 and the smart phone 10. Also, in the above illustrative embodiment, when the user moves to the area in which the time zone and the daylight saving time setting are different, the DST setting is changed to AUTO all the time. However, when the setting has been changed to DST or STD, a setting conforming to the setting may be made.

Also, in the above illustrative embodiment, the smart phone 10 is configured to access the external data server 90 and to acquire the latest daylight saving time implementation information. However, the latest daylight saving time implementation information may be acquired by connecting a portable storage medium, for example, and the setting may be updated by a user operation.

Also, in the above illustrative embodiment, the version information of the daylight saving time implementation information is attached to the entire information but may be individually set for each city. Also, the version information is not a number that increases by one (1) but may be determined based on update date and time, for example. Alternatively, the update situation may be managed based on the update date and time, not as the version information. Also, the version value may be set at the external data server 90 from which the daylight saving time implementation information is to be acquired.

Also, in the above illustrative embodiment, when comparing the versions, the version information is acquired from the electronic timepiece 40. However, when the smart phone 10 to which the electronic timepiece 40 is to be connected is fixed, the version information can be compared by the daylight saving time implementation information transmitted from the smart phone 10 to the electronic timepiece 40 and the daylight saving time implementation information acquired from the external data server 90. Therefore, it may not be necessary to acquire the version information from the electronic timepiece 40. Also, in this case, it is not necessary to transmit the version information to the electronic timepiece 40.

Also, in the above illustrative embodiment, the communication with the external device such as the smart phone 10 is performed using the Bluetooth communication. However, the other wireless communication methods are also possible, and an appropriate method may be selected depending on the power consumption, the communication traffic, the memory capacity and the like. Alternatively, when the wired communication is used as the communication method, a connection terminal of a communication cable is provided on a side surface of the housing of the electronic timepiece 40, for example. Therefore, a connection method (connection cable) is selected within a range in which a size of the connection terminal falls into a size of the electronic timepiece 40. Also, the communication cable is not limited to only the communication utility. For example, when a secondary cell is used as the battery, the communication cable configured to feed the power and to charge the secondary cell is also possible.

Also, in the above illustrative embodiment, the smart phone 10 and the mobile phone have been exemplified as the external electronic device to which the electronic timepiece 40 is to be connected. However, a portable electronic device that is kept and used in the vicinity of the electronic timepiece 40, for example, a PDA (Personal Digital Assistant), a tablet terminal apparatus and the like may also be possible.

Also, in the above descriptions, as the computer-readable medium relating to the storage unit 14 configured to store therein the local time setting managing application 141 of the disclosure, the non-volatile memory such as a flash memory and an EEPROM has been exemplified. However, the disclosure is not limited thereto. For example, as the computer-readable medium, a portable storage medium such as an HDD (Hard Disk Drive), a CD-ROM and a DVD disc may also be applied. Also, the non-volatile memory is preferably a detachable portable type such as a mini SD card and a USB memory or may be a built-in type such as an SSD (Solid State Drive). Also, as a medium configured to provide the data of the program relating to the disclosure through the communication line, a carrier wave is also applied to the disclosure.

In addition, the detailed configurations, the contents and sequences of the processing, and the like described in of the illustrative embodiment can be appropriately changed without departing from the gist of the disclosure.

Although the illustrative embodiments of the disclosure have been described, the scope of the disclosure is not limited to the illustrative embodiments and includes the scope defined in the claims and the equivalent scope thereto.

What is claimed is:

1. An electronic timepiece comprising:

a timer unit that counts local time;

a timepiece-side communication unit that communicates with an external device, and acquires data including a setting position of a local time setting by the communication with the external device;

a timepiece-side storage unit that stores (i) a current position and (ii) daylight saving time implementation information at least at the current position; and a processor that, when the setting position of the local time setting included in the data acquired by the communication with the external device does not match the current position stored in the timepiece-side storage unit, corrects the local time in correspondence to an implementation situation of daylight saving time at the setting position of the local time setting included in the data acquired by the communication with the external device, based on the daylight saving time implementation information, wherein the processor acquires update information of the daylight saving time implementation information from the external device through the timepiece-side communication unit, and reflects the acquired update information in the daylight saving time implementation information.

2. The electronic timepiece according to claim 1, wherein:

the processor further acquires date and time information from the external device; and the processor corrects the local time which is counted by the timer unit, based on the acquired date and time information.

3. The electronic timepiece according to claim 1, wherein:

the timepiece-side storage unit stores an implementation time period of daylight saving time, as the daylight saving time implementation information; and the processor selects an implementation time period of the daylight saving time from the daylight saving time implementation information based on the setting position of the local time setting included in the data acquired by the communication with the external device, and corrects the local time according to the selected implementation time period.

4. The electronic timepiece according to claim 3, wherein:

the processor acquires the update information together with the local time setting.

5. The electronic timepiece according to claim 3, wherein:

the local time setting includes information of a time zone;

the timer unit counts a reference date and time; and the timer unit calculates the local time based on a time difference from the reference date and time in the acquired time zone.

6. The electronic timepiece according to claim 1, further comprising:

an operation unit that receives a user input operation, wherein:

the processor selects a switching setting of switching between (i) correcting the local time in correspondence with a setting as to whether to implement the daylight saving time set by an input operation on the operation unit and (ii) correcting the local time in correspondence to the implementation situation of the daylight saving time at the current position obtained by using the daylight saving time implementation information.

7. The electronic timepiece according to claim 3, further comprising:

an operation unit that receives a user input operation, wherein:

the processor selects a switching setting of switching between (i) correcting the local time in correspondence with a setting as to whether to implement the daylight saving time set by an input operation on the operation unit and (ii) correcting the local time in correspondence to the implementation situation of the daylight saving time at the current position obtained by using the daylight saving time implementation information; and when the setting position of the local time setting included in the data acquired by the communication with the external device matches the current position stored in the timepiece-side storage unit and when the setting as to whether to implement the daylight saving time is set based on a user input operation, the processor corrects the local time in correspondence to the set setting as to whether to implement the daylight saving time.

8. A communication system comprising an electronic timepiece and an electronic device, the electronic timepiece and the electronic device being capable of communicating with each other, the electronic timepiece comprising:

a timer unit that counts local time;

a timepiece-side communication unit that communicates with the electronic device, and that acquires data including a setting position of a local time setting based on the communication with the electronic device;

a timepiece-side storage unit that stores (i) a current position, and (ii) daylight saving time implementation information at least at the current position; and a processor that, when the setting position of the local time setting included in the data acquired by the communication with the electronic device does not match the current position stored in the timepiece-side storage unit, corrects the local time in correspondence to an implementation situation of daylight saving time at the setting position of the local time setting included in the data acquired by the communication with the electronic device, based on the daylight saving time implementation information, wherein the processor acquires update information of the daylight saving time implementation information from the electronic device through the timepiece-side communication unit, and that reflects the acquired update information in the daylight saving time implementation information, and the electronic device comprising:

a device-side communication unit;

a device-side storage unit that stores an implementation time period of daylight saving time therein, as daylight saving time implementation information; and a processor that transmits, as the update information, daylight saving time implementation information at least at the setting position by referring to the daylight saving time implementation information stored in the device-side storage unit, to the electronic timepiece through the device-side communication unit.

9. The communication system according to claim 8, wherein:

the processor of the electronic device determines whether the daylight saving time implementation information stored in the timepiece-side storage unit matches the daylight saving time implementation information stored in the device-side storage unit; and when the processor of the electronic device determines that the daylight saving time implementation information stored in the timepiece-side storage unit does not match the daylight saving time implementation information stored in the device-side storage unit, the processor of the electronic device transmits, as the update information, the daylight saving time implementation information at least at the setting position to the electronic timepiece through the device-side communication unit.

10. A non-transitory storage medium storing a program executable by a computer comprising a device-side communication unit which communicates with an electronic timepiece, the program, when executed by the computer, causing the computer to perform operations comprising:

storing (i) a current position as a setting position, (ii) daylight saving time implementation information, the daylight saving time implementation information including an implementation time period of daylight saving time, and (iii) a local time setting including a time zone including the setting position and the daylight saving time implementation information at the setting position; and transmitting by the device-side communication unit, as update information, the current position stored as the setting position and the local time setting.

11. The storage medium according to claim 10, wherein the program further causes the computer to perform operations comprising:

determining whether daylight saving time implementation information stored in the electronic timepiece matches the daylight saving time implementation information stored in the computer; and when the computer determines that the daylight saving time implementation information stored in the electronic timepiece does not match the daylight saving time implementation information stored in the computer, transmitting by the device-side communication unit, as the update information, a difference between the determined daylight saving time implementation information.

12. The storage medium according to claim 11, wherein the program further causes the computer to perform operations comprising:

when the computer determines that the daylight saving time implementation information stored in the electronic timepiece does not match the daylight saving time implementation information stored in the computer, transmitting by the device-side communication unit the local time setting together with the daylight saving time implementation information at least at the current position stored as the setting position.

13. The storage medium according to claim 12, wherein:

the local time setting includes shift time information to shift the implementation time period of the daylight saving time.

14. The storage medium according to claim 12, wherein the program further causes the computer to perform operations comprising:

acquiring the current position;

determining whether the acquired current position matches a setting position set in the electronic timepiece upon acquisition of the current position; and when the computer determines that the acquired current position does not match the setting position, causing the device-side communication unit to transmit the local time setting.

15. The storage medium according to claim 12, wherein the program further causes the computer to perform operations comprising:

acquiring the current position;

determining whether the acquired current position matches a setting position set in the electronic timepiece upon acquisition of the current position;

when the computer determines that the acquired current position matches the setting position, causing the electronic timepiece to keep a switching setting as to whether to correct the local time in accordance with the daylight saving time implementation information in the electronic timepiece; and when the computer determines that the acquired current position does not match the setting position, causing the electronic timepiece to correct the local time in accordance with the daylight saving time implementation information.

16. The storage medium according to claim 14, wherein the program further causes the computer to perform operations comprising:

acquiring the setting position by receiving information of the setting position transmitted from the electronic timepiece through the device-side communication unit.

17. The storage medium according to claim 11, wherein the program further causes the computer to perform operations comprising:

acquiring updated daylight saving time implementation information from outside;

generating information indicating an update situation of the daylight saving time implementation information each time when the updated daylight saving time implementation information is acquired; and comparing information indicating an update situation of the daylight saving time implementation information upon transmission of the daylight saving time implementation information to the electronic timepiece and information indicating an update situation of the daylight saving time implementation information stored in the computer.

18. The storage medium according to claim 17, wherein:

the information indicating the update situation of the daylight saving time implementation information upon transmission of the daylight saving time implementation information to the electronic timepiece is received from the electronic timepiece through the device-side communication unit.

19. The storage medium according to claim 17, wherein the program further causes the computer to perform operations comprising:

when the implementation time period is changed to a new implementation time period in some areas of a plurality of areas corresponding to the one implementation time period, adding the new implementation time period to the acquired daylight saving time implementation information; and when the implementation time period is changed to a new implementation time period in all areas corresponding to the one implementation time period, overwriting the changed implementation time period to the acquired daylight saving time implementation information.

* * * * *